US009911427B2

(12) United States Patent
Moriya et al.

(10) Patent No.: US 9,911,427 B2
(45) Date of Patent: Mar. 6, 2018

(54) GAIN ADJUSTMENT CODING FOR AUDIO ENCODER BY PERIODICITY-BASED AND NON-PERIODICITY-BASED ENCODING METHODS

(71) Applicant: NIPPON TELEGRAPH AND TELEPHONE CORPORATION, Chiyoda-ku (JP)

(72) Inventors: Takehiro Moriya, Atsugi (JP); Yutaka Kamamoto, Atsugi (JP); Noboru Harada, Atsugi (JP)

(73) Assignee: NIPPON TELEGRAPH AND TELEPHONE CORPORATION, Chiyoda-ku (JP)

( * ) Notice: Subject to any disclaimer, the term of this patent is extended or adjusted under 35 U.S.C. 154(b) by 0 days.

(21) Appl. No.: 15/126,437

(22) PCT Filed: Jan. 13, 2015

(86) PCT No.: PCT/JP2015/050656

§ 371 (c)(1),
(2) Date: Sep. 15, 2016

(87) PCT Pub. No.: WO2015/146224

PCT Pub. Date: Oct. 1, 2015

(65) Prior Publication Data

US 2017/0092283 A1 Mar. 30, 2017

(30) Foreign Application Priority Data

Mar. 24, 2014 (JP) ..... 2014-059502

(51) Int. Cl.

| | |
|---|---|
| ***G10L 19/20*** | (2013.01) |
| ***G10L 19/002*** | (2013.01) |
| ***G10L 19/032*** | (2013.01) |

(52) U.S. Cl.
CPC ..... *G10L 19/20* (2013.01); *G10L 19/002* (2013.01); *G10L 19/032* (2013.01)

(58) Field of Classification Search
CPC ..... G10L 19/002; G10L 19/02; G10L 19/032; G10L 19/18; G10L 19/20; G10L 19/1922
(Continued)

(56) References Cited

U.S. PATENT DOCUMENTS 7,269,554 B2 * 9/2007 Lopez-Estrada ..... G10L 19/02 704/200.1
7,752,039 B2 * 7/2010 Bessette ..... G10L 19/12 704/219

(Continued)

FOREIGN PATENT DOCUMENTS

WO 2012/046685 A1 4/2012

OTHER PUBLICATIONS

3rd Generation Partnership Project(3GPP), Technical Specification (TS) 26.290, "Extended Adaptive Multi-Rate—Wideband (AMR-WB+) codec; Transcoding functions", Version 10.0.0, Mar. 2011 (85 pages).

(Continued)

*Primary Examiner* — Martin Lerner
(74) *Attorney, Agent, or Firm* — Oblon, McClelland, Maier & Neustadt, L.L.P.

(57) ABSTRACT

In an encoding method that is expected to produce a smaller code amount out of a periodicity-based encoding method and a non-periodicity-based encoding method, the amount of code or an estimated value of the amount of code of an integer value sequence which is derived from an audio signal is obtained while adjusting gain. In the other encoding method, an integer value sequence obtained in this process is substituted to obtain the amount of code or an estimated value of the amount of code of the integer value sequence.

(Continued)

The obtained code amounts or estimated values are compared to choose one of the encoding methods and the integer value sequence is encoded using the chosen encoding method to obtain and output an integer signal code.

3 Claims, 7 Drawing Sheets

(58) Field of Classification Search
USPC ..... 704/205, 206, 225, 229, 500, 501
See application file for complete search history.

(56) References Cited

U.S. PATENT DOCUMENTS 7,933,769 B2 * 4/2011 Bessette ..... G10L 19/0208 704/219
8,914,280 B2 * 12/2014 Sung ..... G10L 19/22 704/219
8,918,315 B2 * 12/2014 Oshikiri ..... G10L 19/0208 704/200.1
9,009,036 B2 * 4/2015 Valin ..... G10L 19/038 704/229
9,230,554 B2 * 1/2016 Moriya ..... G10L 19/18
9,524,725 B2 * 12/2016 Moriya ..... G10L 19/032
9,552,821 B2 * 1/2017 Moriya ..... G10L 19/035
2013/0317814 A1 * 11/2013 Moriya ..... G10L 19/12 704/219
2015/0088529 A1 * 3/2015 Moriya ..... G10L 19/035 704/500
2015/0187366 A1 * 7/2015 Moriya ..... G10L 19/265 704/206
2016/0140975 A1 * 5/2016 Kamamoto ..... G10L 19/0212 704/203
2016/0336019 A1 * 11/2016 Kamamoto ..... G10L 19/06
2017/0025132 A1 * 1/2017 Moriya ..... G10L 19/06
2017/0040023 A1 * 2/2017 Moriya ..... G10L 19/02

OTHER PUBLICATIONS

International Search Report dated Mar. 31, 2015 in PCT/JP2015/050656 filed Jan. 13, 2015.

* cited by examiner

GAIN ADJUSTMENT CODING FOR AUDIO ENCODER BY PERIODICITY-BASED AND NON-PERIODICITY-BASED ENCODING METHODS

TECHNICAL FIELD

The present invention relates to an audio signal encoding technique and, in particular, to a technique for encoding a sequence that is obtained by dividing a sample string derived from an audio signal by a gain.

BACKGROUND ART

An adaptive encoding for orthogonal transform coefficients of transform such as DFT (discrete Fourier transform) and MDCT (modified discrete cosine transform) is known as low-bit-rate (for example on the order of 10K bits/s to 20K bits/s) encoding for speech signals and audio signals. For example, AMR-WB+ (Extended Adaptive Multi-Rate Wideband), which is a standard technique described in Non-Patent Literature 1, has TCX (transform coded excitation) encoding modes. In the TCX encoding, a gain is decided for a coefficient string which is obtained by normalizing a frequency-domain audio signal sequence by using a power spectral envelope sequence so that a sequence that is obtained by dividing each coefficient in the coefficient string by the gain can be encoded with a predetermined number of bits, thereby allowing encoding with a total number of bits allocated to each frame.

<Encoder 500>

FIG. 1 illustrates an exemplary configuration of a conventional encoder 500 for TCX encoding. The components illustrated in FIG. 1 will be described below.

<Frequency-Domain Transformer 5001>

A frequency-domain transformer 5001 transforms an input time-domain speech/audio digital signal (hereinafter referred to as an input audio signal) in each frame, which is a predetermined time interval, into a MDCT coefficient string X(1), . . . , X(N) at N points in the frequency domain and outputs the MDCT coefficient string. Here, N is a positive integer.

<Power-Spectral Envelope-Sequence Arithmetic Unit 5002>

A power-spectral envelope-sequence arithmetic unit 5002 performs linear predication analysis of an input audio signal on a frame-by-frame basis to obtain linear predictive coefficients and uses the linear predictive coefficients to obtain and output a power spectral envelope sequence W(1), . . . , W(N) of the input audio signal at N points. The linear predictive coefficients are encoded using a conventional encoding technique and the resulting predictive coefficient code is transmitted to a decoding side.

<Weighted Envelope Normalizer 5003>

A weighted envelope normalizer 5003 uses each of the values in a power spectral envelope sequence W(1), . . . , W(N) obtained by the power-spectral envelope-sequence arithmetic unit 5002 to normalize the value of each of the coefficients X(1), . . . , X(N) in an MDCT coefficient string obtained by the frequency-domain transformer 5001 and outputs a weighted normalized MDCT coefficient string $X_N$(1), . . . , $X_N$(N). In order to achieve quantization that auditorily minimizes distortion, the weighted envelope normalizer 5003 uses a weighted power spectral envelope sequence produced by smoothing the power spectral envelope to normalize each coefficient in the MDCT coefficient string in each frame. Consequently, the weighted normalized MDCT coefficient string $X_N$(1), . . . , $X_N$(N) has a smaller slope of amplitude and fluctuations of amplitude than the input MDCT coefficient string X(1), . . . , X(N) but has magnitude variations similar to those of the power spectral envelope sequence of the input audio signal, that is, has slightly greater amplitudes in a region of coefficients corresponding to low frequencies and has a fine structure due to a pitch period.

<Gain Adjustment Encoder 5100>

A gain adjustment encoder 5100 divides each of the coefficients in an input weighted normalized MDCT coefficient string $X_N$(1), . . . , $X_N$(N) by a gain g and outputs a gain code corresponding to the gain g such that the number of bits of an integer signal code that is obtained by encoding a quantized normalized coefficient sequence $X_Q$(1), . . . , $X_Q$(N), which is a sequence of integer values obtained by quantizing the result of the division, is smaller than or equal to the number B of allocated bits, which is the number of bits allocated in advance, and as large as possible, and also outputs the integer signal code.

The gain adjustment encoder 5100 comprises an initializer 5104, a frequency-domain-sequence quantizer 5105, a variable-length encoder 5106, a determiner 5107, a minimum gain setter 5108, a first branching unit 5109, a first gain updater 5110, a gain increaser 5111, a maximum gain setter 5112, a second branching unit 5113, a second gain updater 5114, a gain reducer 5115, a truncation unit 5116 and a gain encoder 5117.

<Initializer 5104>

The initializer 5104 sets an initial value of the gain g. The initial value of the gain can be decided from factors such as the energy of a weighted normalized MDCT coefficient string $X_N$(1), . . . , $X_N$(N) and the number of bits allocated in advance to a code output from the variable-length encoder 5106. The number of bits allocated in advance to a code output from the variable-length encoder 5106 will be hereinafter referred to as the number B of allocated bits. The initializer 5104 also sets 0 as the initial value of the number of updates of gain.

<Frequency-Domain-Sequence Quantizer 5105>

The frequency-domain-sequence quantizer 5105 quantizes values that is obtained by dividing each of the coefficients in a weighted normalized MDCT coefficient string $X_N$(1), . . . , $X_N$(N) by the gain g to obtain and output a quantized normalized coefficient sequence $X_Q$(1), . . . $X_Q$(N), which is a sequence of integer values.

<Variable-Length Encoder 5106>

The variable-length encoder 5106 encodes an input quantized normalized coefficient sequence $X_Q$(1), . . . , $X_Q$(N) by using variable-length encoding to obtain and outputs a code. The code will be referred to as an integer signal code. The variable-length encoding may use a method that encodes a plurality of coefficients in the quantized normalized coefficient sequence together, for example. The variable-length encoder 5106 measures the number of bits of the integer signal code obtained as a result of the variable-length encoding. The number of bits will be hereinafter referred to as the number c of consumed bits.

<Determiner 5107>

When the number of updates of the gain is equal to a predetermined number or when the number c of consumed bits measured by the variable-length encoder 5106 is equal to the number B of allocated bits, the determiner 5107 outputs a gain, an integer signal code and the number c of consumed bits.

When the number of updates of the gain is smaller than the predetermined number of updates and the number c of consumed bits measured by the variable-length encoder 5106 is greater than the number B of allocated bits, the determiner 5107 performs control to cause a minimum gain setter 5108 to perform the next process; when the number of updates of the gain is smaller than the predetermined number of updates and the number c of consumed bits measured by the variable-length encoder 5106 is less than the number B of allocated bits, the determiner 5107 performs control to cause a maximum gain setter 5112 to perform the next process.

<Minimum Gain Setter 5108>

The minimum gain setter 5108 sets the current value of the gain g as the lower bound $g_{min}$ of the gain ($g_{min} \leftarrow g$). The lower bound $g_{min}$ of the gain represents the minimum allowable value of the gain.

<First Branching Unit 5109>

When an upper bound $g_{max}$ of the gain has already been set, a first branching unit 5109 performs control to cause a first gain updater 5110 to perform the next process; otherwise, the first branching unit 5109 performs control to cause a gain increaser 5111 to perform the next process. Further, the first branching unit 5109 adds 1 to the number of updates of gain.

<First Gain Updater 5110>

The first gain updater 5110 sets the average between the current value of the gain g and the upper bound $g_{max}$ of the gain as a new value of the gain g ($g \leftarrow (g+g_{max})/2$). This is because an optimum value of the gain is between the current value of the gain g and the upper bound $g_{max}$ of the gain. Since the current value of the gain g has been set as the lower bound $g_{min}$ of the gain, it can be also said that the average between the upper bound $g_{max}$ of the gain and the lower bound $g_{min}$ of the gain is set as a new value of the gain g ($g \leftarrow (g_{max}+g_{min})/2$). The set new gain g is input into the frequency-domain-sequence quantizer 5105.

<Gain Increaser 5111>

The gain increaser 5111 sets a value greater than the current value of the gain g as a new value of the gain g. For example, the gain increaser 5111 sets the current value of the gain g plus an amount Δg by which the gain is to be changed, which is a predetermined positive value, as a new value of the gain g ($g \leftarrow g+\Delta g$). Further, when it is found a plurality of successive times that the number c of consumed bits is greater than the number B of allocated bits without the upper bound $g_{max}$ of the gain being set, the gain increaser 5111 uses a value greater than the predetermined value as the amount Δg by which the gain is to be changed. The set new gain g is input into the frequency-domain-sequence quantizer 5105.

<Maximum Gain Setter 5112>

The maximum gain setter 5112 sets the current value of the gain g as the upper bound $g_{max}$ of the gain ($g_{max} \leftarrow g$). The upper bound $g_{max}$ of the gain represents the maximum allowable value of the gain.

<Second Branching Unit 5113>

When the lower bound $g_{min}$ of the gain has already been set, the second branching unit 5113 performs control to cause the second gain updater 5114 to perform the next process; otherwise, the second branching unit 5113 performs control to cause the gain reducer 5115 to perform the next process. Further, the second branching unit 5113 adds 1 to the number of updates of gain.

<Second Gain Updater 5114>

The second gain updater 5114 sets the average between the current value of the gain g and the lower bound $g_{min}$ of the gain as a new value of the gain g ($g \leftarrow (g+g_{min})/2$). This is because an optimum gain value is between the current value of the gain g and the lower bound $g_{min}$ of the gain. Since the current value of the gain g has been set as the upper bound $g_{max}$ of the gain, it can be also said that the average between the upper bound $g_{max}$ of the gain and the lower bound $g_{min}$ of the gain is set as a new value of the gain g ($g \leftarrow (g_{max}+g_{min})/2$). The set new gain g is input into the frequency-domain-sequence quantizer 5105.

<Gain Reducer 5115>

The gain reducer 5115 sets a value smaller than the current value of the gain g as a new value of the gain g. For example, the gain reducer 5115 sets the current value of the gain g minus an amount Δg by which gain is to be changed, which is a predetermined positive value, as a new value of the gain g ($g \leftarrow g-\Delta g$). Further, for example, when it is found a plurality of successive times that the number c of consumed bits is smaller than the number B of allocated bits without lower bound $g_{min}$ of the gain being set, the gain reducer 5115 uses a value greater than the predetermined value as the amount Δg by which the gain is to be changed. The set new gain g is input into the frequency-domain-sequence quantizer 5105.

<Truncation Unit 5116>

When the number c of consumed bits output from the determiner 5107 is greater than the number B of allocated bits, the truncation unit 5116 removes the amount of code equivalent to the bits by which the number c of consumed bits exceeds the number B of allocated bits from the code corresponding to quantized normalized coefficients on the high frequency side in an integer signal code output from the determiner 5107 and outputs the resulting code as a new integer signal code. For example, the truncation unit 5116 removes a portion of code corresponding to quantized normalized coefficients on the high frequency side that correspond to the number of bits by which the number c of consumed bits exceeds the number B of allocated bits, c−B, from the integer signal code and outputs the remaining code as a new integer signal code. On the other hand, when the number c of consumed bits output from the determiner 5107 is not greater than the number B of allocated bits, the truncation unit 5116 outputs the integer signal code output from the determiner 5107.

<Gain Encoder 5117>

The gain encoder 5117 encodes the gain output from the determiner 5107 using a predetermined number of bits to obtain and output a gain code.

On the other hand, Patent Literature 1 describes a variable-length encoding method that uses periodicity to efficiently encode integer signals. In the method, a quantized normalized coefficient sequence is rearranged so that one or a plurality of successive samples including a sample corresponding to a fundamental frequency and one or a plurality of successive samples including a sample corresponding to an integer multiple of the fundamental frequency are put together. The rearranged sample string is encoded using variable-length encoding to obtain an integer signal code. This reduces variations in amplitude of adjacent samples to increase the efficiency of the variable-length encoding.

Patent Literature 1 also describes a method for obtaining an integer signal code by selecting one of two encoding methods, whichever uses or is expected to use fewer bits for an integer signal code; one of the encoding methods uses periodicity and encodes a rearranged sample string by using variable-length encoding to obtain an integer signal code whereas the other method does not use periodicity and encodes the original, unrearranged sample string by using variable-length encoding to obtain an integer signal code. This enables an integer signal code having a fewer bits with the same degree of encoding distortion to be obtained.

PRIOR ART LITERATURE

Patent Literature

Patent literature 1: International Publication No. WO 2012/046685

Non-Patent Literature

Non-patent literature 1: 3rd Generation Partnership Project (3GPP), Technical Specification (TS) 26.290, "Extended Adaptive Multi-Rate-Wideband (AMR-WB+) codec; Transcoding functions", Version 10.0.0 (2011-03)

SUMMARY OF THE INVENTION

Problems to be Solved by the Invention

The existing technique described in Patent Literature 1 decides on a gain before the variable-length encoding using any of the encoding method that uses periodicity to obtain an integer signal code and the encoding method that does not use periodicity to obtain an integer signal code. Accordingly, although the technique can reduce the number of bits of the integer signal code with the same degree of distortion, the technique does not give consideration to achieving both of reduction of the number of bits by variable-length encoding and reduction of quantization distortion by using as small gain value as possible under the condition that the amount of code is kept less than or equal to a given number of bits.

In order to reduce distortion due to variable-length encoding, the existing technique described in Patent Literature 1 needs to be combined with the conventional technique described in Non-Patent Literature 1. However, the combined techniques require the processing by the gain adjustment encoder described above in each of the encoding method that uses periodicity and the encoding method that does not use periodicity and therefore require a very large amount of computation.

Means to Solve the Problems

A frequency-domain sample string derived from an audio signal in each predetermined time interval is obtained and an indicator of the degree of periodicity of the frequency-domain sample string is calculated.

When the indicator corresponds to high periodicity, an integer value sequence which is a string of integer value samples which are obtained by dividing each sample in the frequency-domain sample string by a gain and an estimated value of code amount estimated with the assumption that the integer value sequence is encoded using a periodicity based encoding method or code that is obtained by encoding the integer value sequence using a periodicity based encoding method are obtained by adjusting the gain by a loop process, an estimated value of code amount estimated with the assumption that the integer value sequence is encoded using a non-periodicity based encoding method or code that is obtained by encoding the integer value sequence using the non-periodicity based encoding method are obtained, and an integer signal code which is obtained by encoding the integer value sequence using the encoding method that minimizes the amount of code or the estimated value of the amount of code is output.

When the indicator does not correspond to high periodicity, an integer value sequence which is a string of integer value samples which are obtained by dividing each sample in the frequency-domain sample string by a gain and an estimated value of code amount estimated with the assumption that the integer value sequence is encoded using a non-periodicity-based encoding method or code that is obtained by encoding the integer value sequence using a non-periodicity-based encoding method are obtained by adjusting the gain by a loop process, an estimated value of code amount estimated with the assumption that the integer value sequence is encoded using a periodicity-based encoding method or code that is obtained by encoding the integer value sequence using the periodicity-based encoding method are obtained, and an integer signal code which is obtained by encoding the integer value sequence using the encoding method that minimizes the amount of code or the estimated value of the amount of code is output.

Effects of the Invention

According to the present invention, both of reduction of quantization distortion by using as small gain value as possible under the condition that the amount of code is kept less than or equal to a given number of bits and reduction of the amount of an integer signal code obtained by encoding can be achieved with a small amount of computation.

DETAILED DESCRIPTION OF THE EMBODIMENTS

Figure 1:
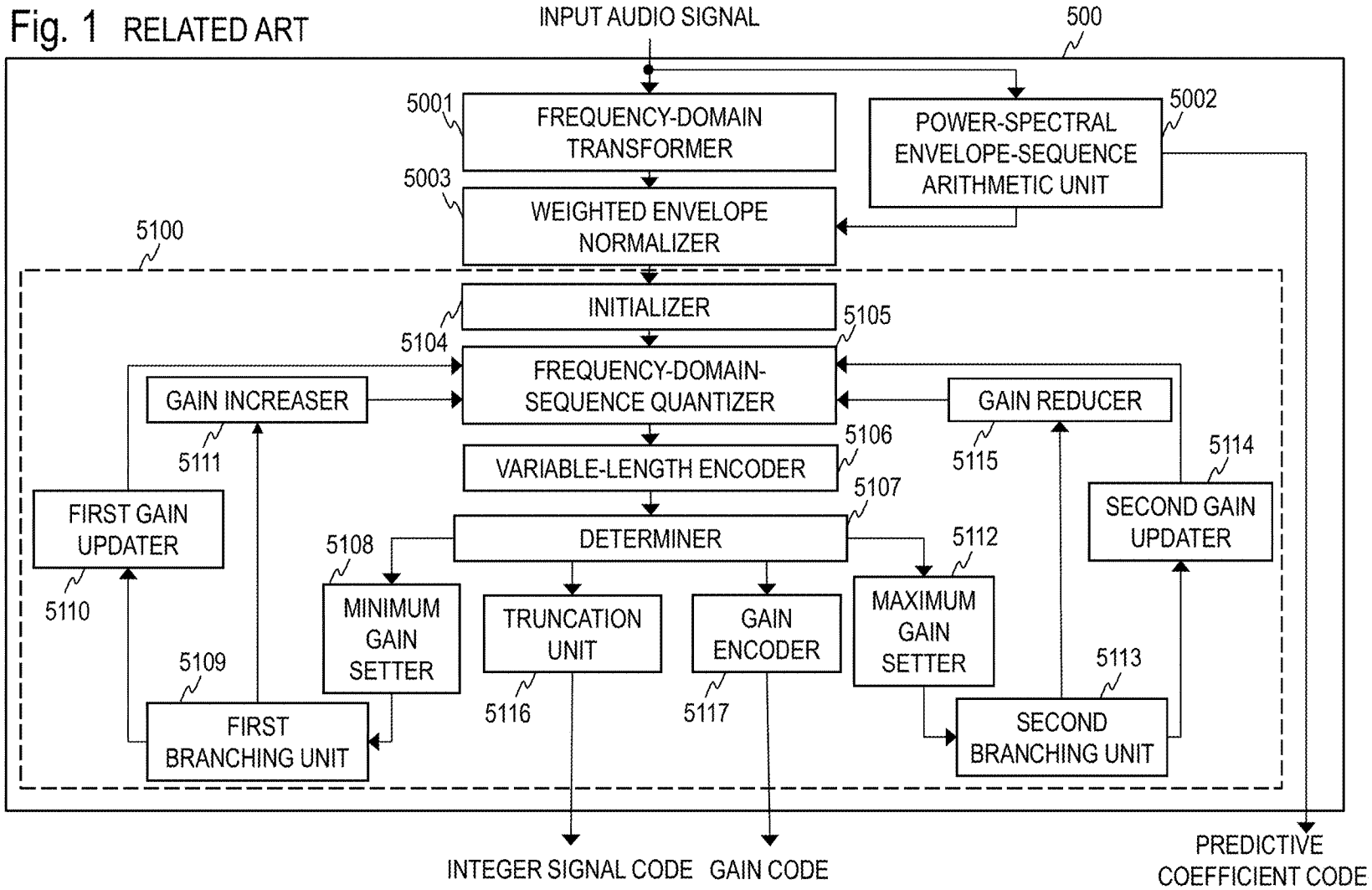
Fig. 1 RELATED ART
FIG. 1 is a block diagram illustrating an exemplary configuration of a conventional encoder.

Embodiments of the present invention will be described with reference to the drawings. Same elements are given same reference numerals and repeated description thereof will be omitted.

First Embodiment

<Encoder 100 (FIG. 2)>

A configuration and processing of an encoder 100 according to a first embodiment will be described with reference to FIGS. 2 to 4.

Figure 2:
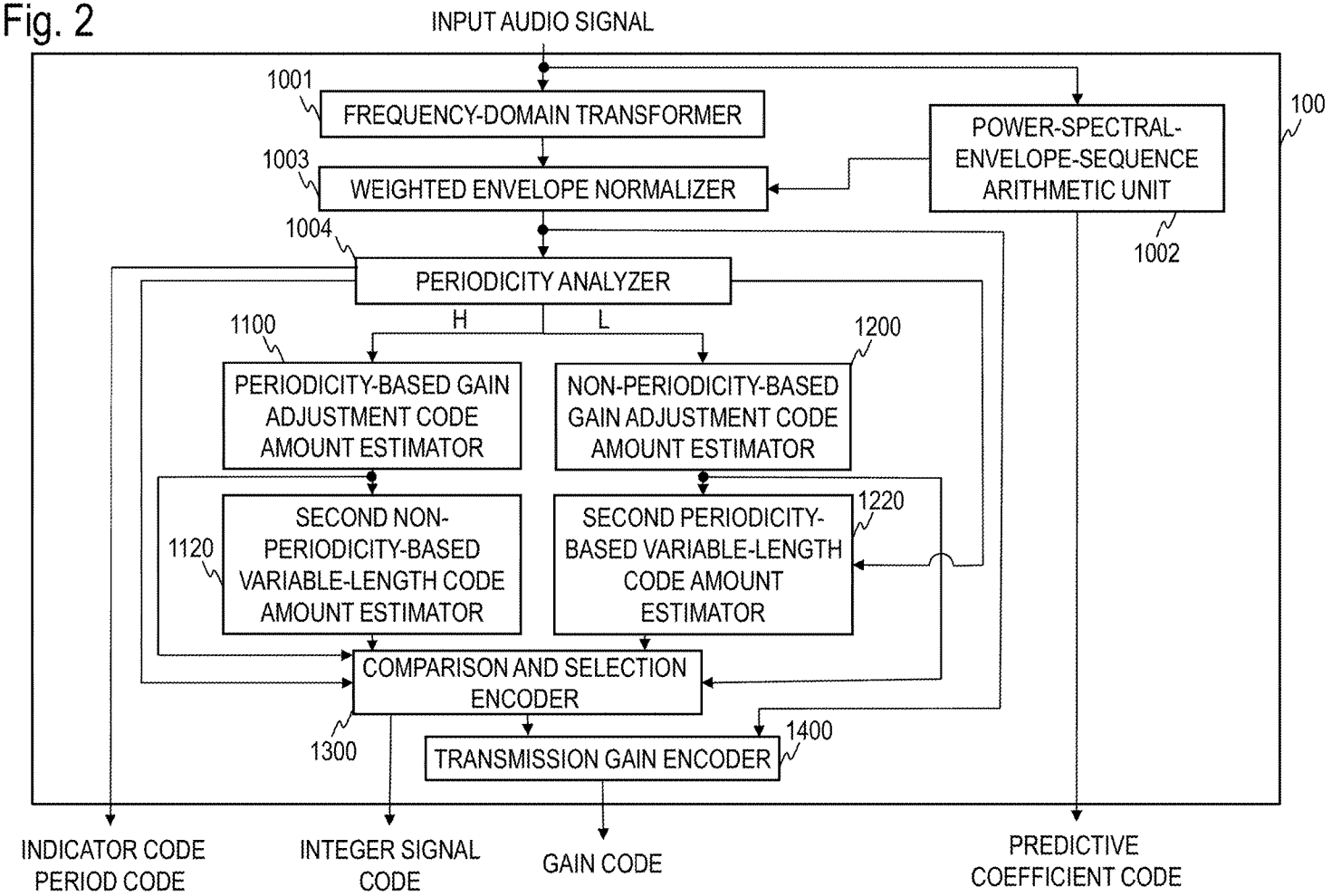
FIG. 2 is a block diagram illustrating an exemplary configuration of an encoder according to a first embodiment.

As illustrated in FIG. 2, the encoder 100 according to the first embodiment comprises a frequency-domain transformer 1001, a power-spectral-envelope-sequence arithmetic unit 1002, a weighted envelope normalizer 1003, a periodicity analyzer 1004, a periodicity-based gain adjustment code amount estimator 1100, a second non-periodicity-based variable-length code amount estimator 1120, a non-periodicity-based gain adjustment code amount estimator 1200, a second periodicity-based variable-length code amount estimator 1220, a comparison and selection encoder 1300 and a transmission gain encoder 1400. The encoder 100 is a device, for example, that is configured by loading a predetermined program into a general-purpose or special-purpose computer including a processor (a hardware processor) such as a CPU (central processing unit) and a memory such as a RAM (random-access memory). The CPU is a type of electronic circuitry and some or all of processing parts making up the encoder 100 may be implemented by other electronic circuitry.

<Frequency-Domain Transformer 1001>

Frequency-domain transformer 1001 transforms an input audio digital signal (herein after referred to as an input audio signal) in each frame, which is a predetermined time interval, into an MDCT coefficient string X(1), . . . , X(N) at N points in the frequency domain and outputs the MDCT coefficient sequence. Here, N is a positive integer.

<Power-Spectral-Envelope-Sequence Arithmetic Unit 1002>

The power-spectral-envelope-sequence arithmetic unit 1002 performs linear prediction analysis of an input audio signal on a frame-by-frame basis to obtain linear predictive coefficients and uses the linear predictive coefficients to obtain and output a power spectral envelope sequence W(1), . . . , W(N) at N points of the input audio signal. The coefficients W(1), . . . , W(N) of the N-point power spectral envelope sequence is obtained by converting the linear predictive coefficients into the frequency domain. For example, according to a p-order autoregressive process (where p is a positive integer), which is an all-pole model, an input audio signal x(t) at a time point t can be expressed by Equation (1) with past values x(t−1), . . . , x(t−p) of the signal itself at the past p time points, prediction residuals e(t) and linear predictive coefficients $\alpha_1, \ldots, \alpha_p$. The coefficients W(n) [1≤n≤N] of the power spectral envelope sequence can be expressed by Equation (2), where exp(•) is an exponential function with a base of Napier's constant, j is an imaginary unit, and $\sigma^2$ is prediction residual energy.

[Equation 1]

$$x(t) + \alpha_1 x(t-1) + \ldots + \alpha_p x(t-p) = e(t) \tag{1}$$

$$W(n) = \frac{\sigma^2}{2\pi} \frac{1}{|1 + \alpha_1 \exp(-jn) + \alpha_2 \exp(-2jn) + \ldots + \alpha_p \exp(-pjn)|^2} \tag{2}$$

Note that instead of the power-spectral-envelope-sequence arithmetic unit 1002, another part, not depicted, in the encoder 100 may calculate linear predictive coefficients. Since a decoder needs to obtain the same values as those obtained at the encoder 100, quantized linear predictive coefficients and/or power spectral envelope sequences are used in the decoder. Hereinafter the term "linear predictive coefficient" or "power spectral envelope sequence" means a quantized linear predictive coefficient or power spectral envelope sequence unless otherwise stated. Further, linear predictive coefficients are encoded using a conventional encoding technique, for example, and the resulting predictive coefficient code is transmitted to the decoding side. Examples of the conventional encoding technique include an encoding technique that produces a code corresponding to linear predictive coefficients themselves as a predictive coefficient code, an encoding technique that converts linear predictive coefficients to LSP parameters and produces a code corresponding to the LSP parameters as a predictive coefficient code, and an encoding technique that converts linear predictive coefficients to PARCOR coefficients and produces a code corresponding to the PARCOR coefficients as a predictive coefficient code.

<Weighted Envelope Normalizer 1003>

The weighted envelope normalizer 1003 uses values in a power spectral envelope sequence W(1), . . . , W(N) obtained by the power-spectral-envelope-sequence arithmetic unit 1002 to normalize values in an MDCT coefficient string X(1), . . . , X(N) obtained by the frequency-domain transformer 1001, thereby obtaining and outputting a weighted normalized MDCT coefficient string $X_N$(1), . . . , $X_N$(N) (i.e. a frequency-domain sample string derived from an audio signal in each predetermined time interval). Here, in order to achieve quantization that auditorily minimizes distortion, the weighted envelope normalizer 1003 uses values in a weighted power spectral envelope sequence obtained by smoothing the power spectral envelope to normalize the coefficients in the MDCT coefficient string. Consequently, the weighted normalized MDCT coefficient string $X_N$(1), . . . , $X_N$(N) has a smaller slope of amplitude and fluctuations of amplitude than the MDCT coefficient string X(1), . . . , X(N) obtained by the frequency-domain transformer 1001 but has magnitude variations similar to those of the power spectral envelope sequence of the input audio signal, that is, has slightly greater amplitudes in a region of coefficients corresponding to low frequencies and has a fine structure due to a pitch period.

[Examples of Weighted Envelope Normalization Processing]

While two examples of weighted envelope normalization processing are given here, the present invention is not limited to the examples.

Example 1

The weighted envelope normalizer 1003 performs processing for obtaining the coefficients $X_N$(1)=X(1)/sqrt($W_\gamma$(1)), . . . , $X_N$(N)=X(N)/sqrt($W_\gamma$(N)) in a weighted normalized MDCT coefficient string by dividing each of the coefficients X(1), . . . , X(N) in an MDCT coefficient string by the square root sqrt($W_\gamma$(n)) of a correction value $W_\gamma$(n) of each value W(n) in a power spectral envelope sequence that corresponds to the coefficient. The correction value $W_\gamma$(n) [1≤n≤N] is given by Equation (3). Here, γ is a positive constant smaller than or equal to 1 that smoothes power spectral coefficients.

[Equation 2]

$$W_\gamma(n) = \frac{\sigma^2}{2\pi\left(1 + \sum_{i=1}^{p} \alpha_i \gamma^i \exp(-ijn)\right)^2} \tag{3}$$

Example 2

The weighted envelope normalizer 1003 performs processing for obtaining the coefficients $X_N$(1)=X(1)/sqrt(W(1)$^\beta$), . . . , $X_N$(N)=X(N)/sqrt(W(N)$^\beta$) in a weighted normalized MDCT coefficient string by dividing each coefficient X(n) in an MDCT coefficient string by the square root sqrt($W(n)^{\beta}$) of a value $W(n)^{\beta}$ obtained by raising each value W(n) in a power spectral envelope sequence that corresponds to the coefficient to the power of β (0<β<1).

As a result, a weighted normalized MDCT coefficient string in each frame is obtained. The weighted normalized MDCT coefficient string has a smaller slope of amplitude and fluctuations of amplitude than the MDCT coefficient string obtained by the frequency-domain transformer 1001 but has magnitude variations similar to those of the power spectral envelope of the MDCT coefficient string obtained by the frequency-domain transformer 1001, that is, has slightly greater amplitudes in a region of coefficients corresponding to low frequencies and has a fine structure due to a pitch period.

Note that because the reverse of the weighted envelope normalization processing, i.e. a process for reconstructing the MDCT coefficient string from the weighted normalized MDCT coefficient string is performed at the decoding side, the method for calculating a weighted power spectral envelope sequence from a power spectral envelope sequence needs to be common to the encoding side and decoding side.

<Periodicity Analyzer 1004>

The periodicity analyzer 1004 takes an input of a weighted normalized MDCT coefficient string $X_N(1), \ldots, X_N(N)$ output from the weighted envelope normalizer 1003 and obtains and outputs an indicator S of the degree of the periodicity of the weighted normalized MDCT coefficient string (i.e. an indicator of the degree of periodicity of a frequency-domain sample sequence) and a period T of the weighted normalized MDCT coefficient string $X_N(1), \ldots, X_N(N)$.

In addition, the periodicity analyzer 1004 encodes the period T to obtain and output a period code which is a code corresponding to the period T. Any method for encoding the period T may be used that allows the decoder to decode the period code back to the same value as the period T. Further, the periodicity analyzer 1004 may encode the indicator S to obtain and output an indicator code which is a code corresponding to the indicator S. Any method for encoding the indicator S may be used that allows the decoder to decode the indicator code back to the same value as the indicator S. Note that the periodicity analyzer 1004 does not need to obtain and output an indicator code if the decoder can calculate the indicator S without using an indicator code.

The indicator S of the degree of periodicity is an indicator that indicates the degree at which the amplitude of weighted normalized MDCT coefficients periodically increases. In other words, the indicator S may be any indicator such that the greater the value of S, the greater the degree of periodicity (the higher the periodicity). The indicator S of the degree of periodicity is input into the comparison and selection encoder 1300. If an indicator code corresponding to the indicator S is generated, the indicator code is transmitted to the decoder.

The period T is information that corresponds to intervals at which a weighted normalized MDCT coefficient periodically takes a large value. The period T is a positive value. The period T may be an integer or a decimal fraction (for example, 5.0, 5.25, 5.5, 5.75). When the indicator S of the degree of periodicity is greater than a predetermined threshold TH (H: when the indicator S corresponds to high periodicity, i.e. when the periodicity is high), the period T is input into the periodicity-based gain adjustment code amount estimator 1100 and the comparison and selection encoder 1300; when the indicator S of the degree of periodicity is lower than or equal to the predetermined threshold TH (L: when the indicator S does not correspond to high periodicity, i.e. when the indicator S corresponds to low periodicity, in other words, when the periodicity is low), the period T is input into the second periodicity-based variable-length code amount estimator 1220 and the comparison and selection encoder 1300. The determination may be made by the periodicity analyzer 1004 or another part, not depicted. The period code corresponding to the period T is transmitted to the decoder.

An example of the indicator S of the degree of periodicity will be given below. Here, i in a weighted normalized MDCT coefficient $X_N(i)$ (i=1, 2, . . . , N) is referred to as the index of a weighted normalized MDCT coefficient. When the amplitude of weighted normalized MDCT coefficients periodically increases, it means that the value of a coefficient $X_N(V\times T_f)$ (where V is a positive integer) corresponding to an index that is an integer multiple of a predetermined time interval $T_f$ (where $T_f$ is a positive integer) is greater than a coefficient that corresponds to another index. Consequently, the greater the degree of periodicity, the greater the sum of the absolute values of amplitudes of weighted normalized MDCT coefficients that have indices that are integer multiples of $T_f$. Therefore, the indicator S of the degree of periodicity is obtained, for example, by

[Equation 3]

$$S=\Sigma_{k\in G1(T_f)}|X_N(k)| \tag{4}$$

Here, $G1(T_f)$ is a set of indices that are integer multiples of $T_f$, i.e. $G1(T_f)=\{T_f, 2T_f, 3T_f, \ldots, V_{max}\times T_f\}$, (interval criterion 1). Here, $V_{max}$ is a positive integer that satisfies $V_{max}\times T_f\leq N$. $V_{max}$ may be the maximum positive integer that satisfies $V_{max}\times T_f\leq N$ or may be a positive integer that is smaller than the maximum positive integer that satisfies $V_{max}\times T_f\leq N$. $|X_N(k)|$ represents the absolute value of $X_N(k)$. Instead of the absolute value of amplitude, the sum of the squares (energy) of amplitude may be used as the indicator S.

[Equation 4]

$$S=_{k\in G1(T_f)}X_N^2(k) \tag{5}$$

The average of amplitudes may be used as the indicator S because a large sum of the absolute values of amplitudes or a large sum of energy means that the average of the absolute values of amplitudes or the average of the energy is large.

[Equation 5]

$$S=\frac{\sum_{k\in G1(T_f)}|X_N(k)|}{\mathrm{card}(G1(T_f))} \tag{6}$$

Here $\mathrm{card}(G1(T_f))$ represents the number of elements of a set $G1(T_f)$, i.e. the total number of indices included in $G1(T_f)$. Alternatively, the indicator S may be the sum, average or weighted sum of monotonically increasing function values of the magnitudes of amplitudes $X_N(k)$ corresponding to the indices included in $G1(T_f)$. The greater the value of any of these indicators S, the greater the degree of periodicity.

Note that when the degree of periodicity is high, it is likely that coefficients with indices neighboring an index that is an integer multiple of $T_f$, for example $X_N(V\times T_f-1)$ and $X_N(V\times T_f+1)$, have greater amplitudes than coefficients with the other indices. Therefore, indices that are neighboring integer multiples of $T_f$ may be included in $G1(T_f)$ in addition to the indices that are integer multiples of $T_f$ (i.e. $T_f$, $2T_f$, $3T_f$, . . . , $V_{max}\times T_f$) (interval criterion 2). For example, $G1(T_f)$ may be: $G1(T_f)=\{T_f-1, T_f, T_f+1, 2T_f-1, 2T_f, 2T_f+1, \ldots, V_{max}\times T_f-1, V_{max}\times T_f, V_{max}\ T_f+1\}$. Note that indices neighboring an index that is an integer multiple of $T_f$ are integers greater than or equal to $V\times T_f-\delta_1$ and less than or equal to $V\times T_f+\delta_2$, where $\delta_1$ and $\delta_2$ are positive integers and $\delta_1=\delta_2$ or $\delta_1\neq\delta_2$. Alternatively, $G1(T_f)$ may be a set of some of indices in a set made up of the indices that are integer multiples of $T_f$ and indices neighboring the indices that are the integer multiples of $T_f$(interval criterion 3). For example, $G1(T_f)$ may be a set made up of some of indices that are integer multiples of $T_f$ and some of indices neighboring the indices that are integer multiples of $T_f$, or may be a set made up only of some of indices that are integer multiples of $T_f$, or may be a set made up only of indices neighboring indices that are integer multiple of $T_f$, or may be a set made up only of some of indices neighboring indices that are integer multiples of $T_f$. In this case, "some of indices" may be selected by any method; for example, "some of indices" may be indices less than or equal to the index that corresponds to a predetermined frequency (for example indices that correspond to frequencies lower than or equal to a predetermined frequency) or may be indices greater than or equal to the index corresponding to a predetermined frequency (for example, indices that correspond to frequencies higher than or equal to a predetermined frequency).

Further, $T_f$ may be a positive decimal fraction. In this case, a set $G1(T_f)$ may be set according to an interval criterion in which "$T_f$" in any of the interval criteria described above is replaced with the "nearest integer $R(T_f)$ to which $T_f$ is rounded off" (hereinafter the nearest integer to which a is rounded off is denoted by $R(\alpha)$). A set $G1(T_f)$ may be set according to an interval criterion in which "integer multiples of $T_f$" in the any of the interval criteria described above are replaced with the "nearest integers to which integer multiples of $T_f$ are rounded off". A set $G1(T_f)$ may be set according to an interval criterion in which "integers multiple of $T_f$" and "neighbors of an integer multiple of $T_f$" in any of the interval criteria described above are replaced with the "nearest integers to which integer multiples of $T_f$ are rounded off" and the "nearest integers to which neighbors of an integer multiple of $T_f$ are rounded off", respectively. For example, a set may be $G1(T_f)=\{R(T_f), 2R(T_f), 3R(T_f), \ldots, V_{max}\times R(T_f)\}$ or $G1(T_f)=\{R(T_f), R(2T_f), R(3T_f), \ldots, R(V_{max}\times T_f)\}$, or $G1(T_f)=\{R(T_f)-1, R(T_f), R(T_f)+1, 2R(T_f)-1, 2R(T_f), 2R(T_f)+1, \ldots, V_{max}\times R(T_f)-1, V_{max}\times R(T_f), V_{max}\times R(T_f)+1\}$, or $G1(T_f)==\{R(T_f)-1, R(T_f), R(T_f)+1, R(2T_f)-1, R(2T_f), R(2T_f)+1, \ldots, R(V_{max}\times T_f)-1, R(V_{max}\times T_f), R(V_{max}\times T_f)+1\}$, or $G1(T_f)=\{R(T_f-1), R(T_f), R(T_f+1), R(2T_f-1), R(2T_f), R(2T_f+1), \ldots, R(V_{max}\times T_f-1), R(V_{max}\times T_f), R(V_{max}\times T_f+1)\}$.

$T_f$ corresponds to a pitch period in the frequency domain. The pitch period in the frequency domain may be a positive integer or a positive decimal fraction. If the pitch period $T_p$ in the frequency domain has been obtained by a part, not depicted, in the encoder 100, $T_p$ may be output as the period T and $T_f$ may be replaced with $T_p$ to obtain and output the indicator S described above. If a frequency-domain fundamental frequency f has been obtained by a part, not depicted, in the encoder 100, $T=f_s/f$ or $T=R(f_s/f)$ may be output as the period T, where $f_s$ is the sampling frequency, and T may be used as $T_f$ to obtain and output the indicator S described above. If a time-domain fundamental frequency or pitch period has been obtained by a part, not depicted, in the encoder 100, the time-domain fundamental frequency or pitch period may be converted to a frequency-domain period, the converted interval T' may be output as the period T, and the T (=T') may be used as $T_f$ to obtain and output the indictor S described above. For example, the converted interval T' can be calculated according to Equation (7) or (8) given below:

$$T'=N\times 2/L-½ \tag{7}$$

$$T'=INT(N\times 2/L) \tag{8}$$

where L is the time-domain pitch period and INT( ) represents a value in which the fractional part of the value in ( ) is dropped. Here, the converted interval T' obtained according to Equation (7) is not necessarily an integer. On the other hand, Equation (8) is equal to a value obtained by rounding Equation (7) off to the nearest integer by adding ½ to Equation (7) and dropping the fractional part. Thus, the converted interval T' obtained according to Equation (8) is an integer.

Further, integer multiples $U'\times T'$ of a converted interval T' obtained by converting a fundamental frequency or pitch period obtained in the time domain into the frequency domain and integer multiples $U\times T_p$ of a pitch period $T_p$ obtained in the frequency domain may be set as candidate periods, the candidate periods are used as $T_f$ to calculate the indicators S described above, and the largest one of the indicators S may be output as the indicator S of the degree of periodicity, and the candidate period that yields the largest value may be output as the period T. Here, U and U' are positive integers. Specifically, the following process may be performed.

First, the periodicity analyzer 1004 sets $U'\times T'$ and/or $U\times T_p$ as candidate periods for U and/or U' in a predetermined range, for example. The predetermined range may be a range including 1 or excluding 1. For example, if the predetermined range is from 1 (inclusive) to 8 (inclusive), candidate periods are T', 2T', 3T', 4T', 5T', 6T', 7T', 8T' and/or $T_p$, $2T_p$, $3T_p$, $4T_p$, $5T_p$, $6T_p$, $7T_p$, $8T_p$; if the predetermined range is from 3 (inclusive) to 8 (inclusive), candidate periods are 3T', 4T', 5T', 6T', 7T', 8T' and/or $3T_p$, $4T_p$, $T_p$, $6T_p$, $7T_p$, $8T_p$. Then the periodicity analyzer 1004 decides a set $G1(T_f)$, where $T_f$ is the candidate periods, and obtains an indicator S for each of the candidates as described above. The periodicity analyzer 1004 then selects the largest one of the obtained indicators S, outputs the largest indicator S as the indicator S of the degree of periodicity, and outputs the candidate period that yields the largest value as the period T.

In another example, in addition to a converted interval T' and its integer multiples $U'\times T'$ and/or a pitch period $T_p$ and its integer multiples $U\times T_p$, values neighboring these values may be chosen as candidate periods, the candidate periods are used as $T_f$ to calculate the indicators S described above, the largest one of the indicators S may be output as the indicator S of the degree of periodicity, and the candidate period that yields the largest indicator S may be output as the period T. For example, if the predetermined range is from 1 (inclusive) to 8 (inclusive), the candidate periods may be T'−1, T', T'+1, 2T'−1, 2T', 2T'+1, 3T'−1, 3T', 3T'+1, 4T'−1, 4T', 4T'+1, 5T'−1, 5T', 5T'+1, 6T'−1, 6T', 6T'+1, 7T'−1, 7T', 7T'+1, 8T'−1, 8T', 8T'+1 and/or $T_p-1$, $T_p$, $T_p+1$, $2T_p-1$, $2T_p$, $2T_p+1$, $3T_p-1$, $3T_p$, $3T_p+1$, $4T_p-1$, $4T_p$, $4T_p+1$, $5T_p-1$, $5T_p$, $5T_p+1$, $6T_p-1$, $6T_p$, $6T_p+1$, $7T-1$, $7T_p$, $7T_p+1$, $8T_p-1$, $8T_p$, $8T_p+1$. Alternatively, candidate periods may be neighbors of a converted interval T' and its integer multiples $U'\times T'$ and/or neighbors of a pitch period $T_p$ and its integer multiple $U\times T_p$, excluding the converted interval T' and its integer multiples $U'\times T'$ and/or the pitch period $T_p$ and its integer multiples $U \times T_p$. For example, if the predetermined range is from 1 (inclusive) to 8 (inclusive), candidate periods may be T'−1, T'+1, 2T'−1, 2T'+1, 3T'−1, 3T'+1, 4T'−1, 4T'+1, 5T'−1, 5T'+1, 6T'−1, 6T'+1, 7T'−1, 7T'+1, 8T'−1, 8T'+1 and/or $T_p-1$, $T_p+1$, $2T_p-1$, $2T_p+1$, $3T_p-1$, $3T_p+1$, $4T_p-1$, $4T_p+1$, $5T_p-1$, $5T_p+1$, $6T_p-1$, $6T_p+1$, $7T_p-1$, $7T_p+1$, $8T_p-1$, $8T_p+1$. Alternatively, candidate periods may be some of the elements of a set made up of a converted interval T' and its integer multiples U'×T' and/or a pitch period $T_p$ and its integer multiples $U \times T_p$ and their neighbors. The predetermined range may be a range that consists of one interval or a range that consists of a plurality of intervals. For example, the predetermined range may be a range that consists of more than or equal to 1 but fewer than or equal to 3 intervals and a range that consists of more than or equal to 7 but fewer than or equal to 10 intervals.

<Periodicity-Based Gain Adjustment Code Amount Estimator 1100 (FIG. 2)>

A process by the periodicity-based gain adjustment code amount estimator 1100 is performed when it is determined by the periodicity analyzer 1004 or the like that the indicator S is greater than the predetermined threshold TH (periodicity is high). The process by the periodicity-based gain adjustment code amount estimator 1100 takes inputs of a weighted normalized MDCT coefficient string $X_N(\mathbf{1}), \ldots, X_N(N)$ and a period T and adjusts the value of the gain g by performing a gain loop process (i.e. a loop process) to obtain and output a quantized normalized coefficient sequence $X_Q(\mathbf{1}), \ldots, X_Q(N)$ and a first periodicity-based code amount estimated value $c_{H1}$. Note that the term loop process is interchangeable with the term iterative convergence process or rate-loop.

Gain g is a value for normalizing the coefficients $X_N(\mathbf{1}), \ldots, X_N(N)$ in a weighted normalized MDCT coefficient string and is equivalent to the ratio between a weighted normalized MDCT coefficient $X_N(n)$ and a quantized normalized coefficient $X_Q(n)$ (n=1, 2, . . . , N). It is assumed here that the coefficients $X_N(\mathbf{1}), \ldots, X_N(N)$ included in one weighted normalized MDCT coefficient string are normalized using a common gain g. Specifically, a quantized normalized coefficient sequence $X_Q(\mathbf{1}), \ldots, X_Q(N)$ is a sequence of values $X_Q(n)$ obtained by dividing each of the coefficients $X_N(n)$ in a weighted normalized MDCT coefficient string $X_N(\mathbf{1}), \ldots, X_N(N)$ by a common gain g and quantizing the resulting values $X_N(n)/g$ to integer values. The quantized normalized coefficient sequence $X_Q(\mathbf{1}), \ldots, X_Q(N)$ is equivalent to an "integer value sequence that is a sequence of integer value samples which are obtained by dividing each sample in a frequency-domain sample string by a gain". A first periodicity-based code amount estimated value $c_{H1}$ is an estimated value of the amount of code of the quantized normalized coefficient sequence $X_Q(\mathbf{1}), \ldots, X_Q(N)$ estimated with the assumption that the quantized normalized coefficient sequence $X_Q(\mathbf{1}), \ldots, X_Q(N)$ (that is a sequence of integer values) is encoded using a periodicity-based encoding method. The gain loop process is a process that is repeated while increasing the value of the gain by a minimum gain setter 1105, a first branching unit 1106, a first gain updater 1107, and a gain increaser 1108 or decreasing the value of the gain by a maximum gain setter 1109, a second branching unit 1110, a second gain updater 1111, and a gain reducer 1112. One example of the gain loop process is used in AMR-WB+ and other encoding in Non-Patent Literature 1 described previously.

The periodicity-based gain adjustment code amount estimator 1100 takes inputs of a quantized normalized coefficient sequence $X_Q(\mathbf{1}), \ldots, X_Q(N)$ and a period T output from the periodicity analyzer 1004 and adjusts the gain g by the gain loop process to obtain and output a quantized normalized coefficient sequence $X_Q(\mathbf{1}), \ldots, X_Q(N)$ (i.e. a sequence of integer values) such that an estimated value of the amount of code (an estimated number of bits) estimated with the assumption that the quantized normalized coefficient sequence $X_Q(\mathbf{1}), \ldots, X_Q(N)$ is encoded using the periodicity-based encoding method is smaller than or equal to the number B of allocated bits, which is the number of bits allocated in advance, and as large as possible. In addition, the periodicity-based gain adjustment code amount estimator 1100 outputs the estimated number of bits. The estimated number of bits is referred to as the "first periodicity-based code amount estimated value $c_{H1}$" since the estimated number of bits output from the periodicity-based gain adjustment code amount estimator 1100 is an estimated value of the amount of code of an encoding method that uses periodicity.

Figure 3:
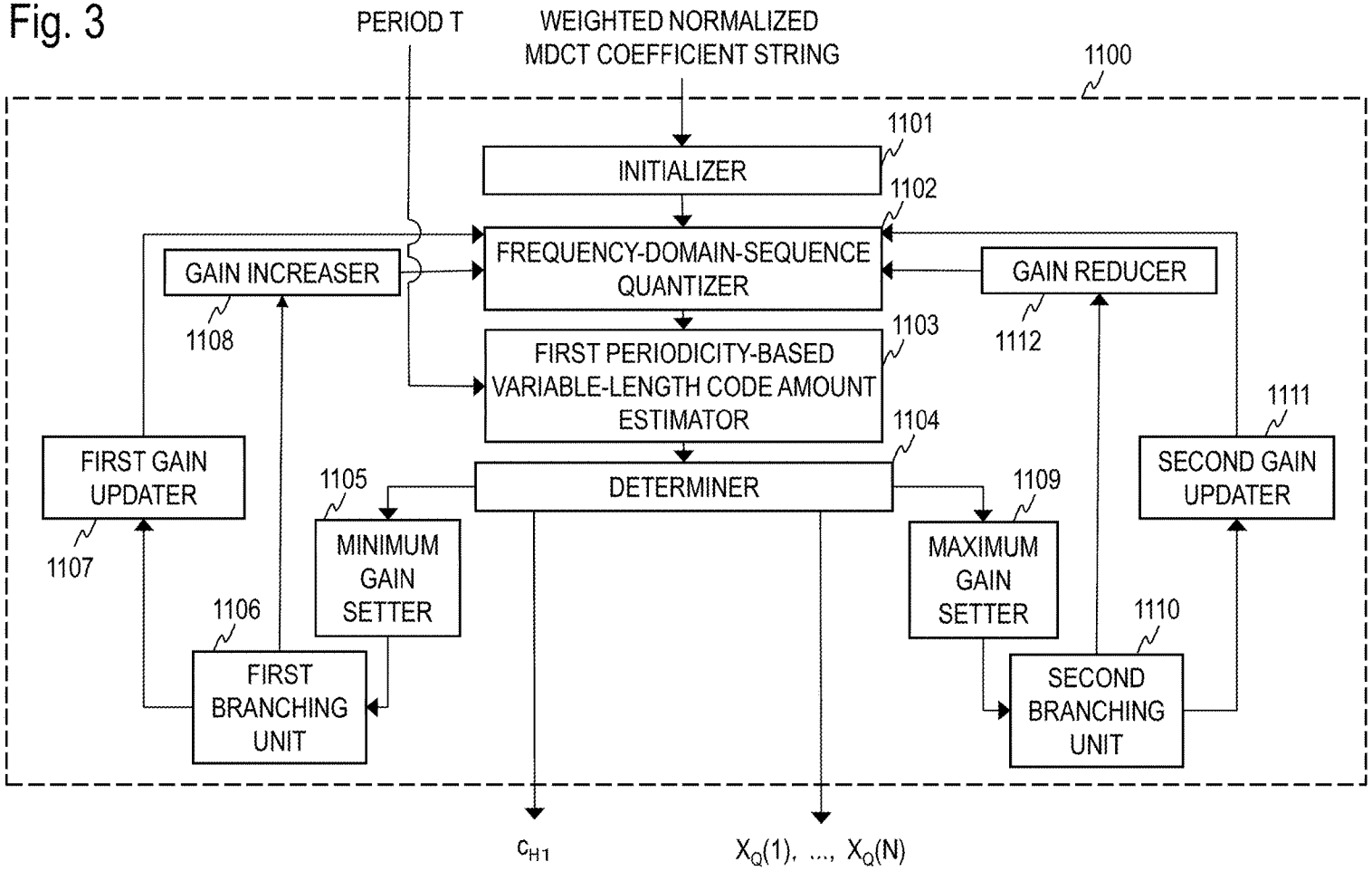
FIG. 3 is a block diagram illustrating an exemplary configuration of a periodicity-based gain adjustment code amount estimator according to the first embodiment.

FIG. 3 illustrates a detailed exemplary configuration of the periodicity-based gain adjustment code amount estimator 1100. The periodicity-based gain adjustment code amount estimator 1100 comprises, for example, an initializer 1101, a frequency-domain-sequence quantizer 1102, a first periodicity-based variable-length code amount estimator 1103, a determiner 1104, a minimum gain setter 1105, a first branching unit 1106, a first gain updater 1107, a gain increaser 1108, a maximum gain setter 1109, a second branching unit 1110, a second gain updater 1111, and a gain reducer 1112.

<Initializer 1101 (FIG. 3)>

The initializer 1101 sets an initial value of the gain g. The initial value of the gain can be decided from factors such as the energy of a weighted normalized MDCT coefficient string $X_N(\mathbf{1}), \ldots, X_N(N)$ and the number of bits allocated in advance to a code output from the comparison and selection encoder 1300. The initial value of the gain g is a positive value. The number of bits allocated in advance to an integer signal code output from the comparison and selection encoder 1300 will be hereinafter referred to as the number B of allocated bits. The initializer 1101 also sets 0 as the initial value of the number of updates of the gain.

<Frequency-Domain-Sequence Quantizer 1102>

The frequency-domain-sequence quantizer 1102 quantizes values $X_N(\mathbf{1})/g, \ldots, X_N(N)/g$ which are obtained by dividing each value in a weighted normalized MDCT coefficient string $X_N(\mathbf{1}), \ldots, X_N(N)$ by the gain g to obtain and output a quantized normalized coefficient sequence $X_Q(\mathbf{1}), \ldots, X_Q(N)$ which is a sequence of integer values. The output quantized normalized coefficient sequence $X_Q(\mathbf{1}), \ldots, X_Q(N)$ is input into the first periodicity-based variable-length code amount estimator 1103.

<First Periodicity-Based Variable-Length Code Amount Estimator 1103>

The first periodicity-based variable-length code amount estimator 1103 obtains an estimated value c of the amount of code (an estimated number of bits) of an integer signal code corresponding to the quantized normalized coefficient sequence $X_Q(\mathbf{1}), \ldots, X_Q(N)$ that is estimated with the assumption that the quantized normalized coefficient sequence $X_Q(\mathbf{1}), \ldots, X_Q(N)$ output from the frequency-domain-sequence quantizer 1102 is encoded using the periodicity-based encoding method as variable-length encoding, and outputs the estimated number c of bits and the quantized normalized coefficient sequence $X_Q(\mathbf{1}), \ldots, X_Q(N)$. The estimated number c of bits and the quantized normalized coefficient sequence $X_Q(\mathbf{1}), \ldots, X_Q(N)$ output from the first periodicity-based variable-length code amount estimator 1103 are input into the determiner 1104.

[Periodicity-Based Encoding Method]

An example of variable-length encoding that uses the periodicity-based encoding method will be described. In the periodicity-based encoding method, for example sample group Gr1 made up of all or some of one or a plurality of successive coefficients (hereinafter also referred to as samples), including a sample that corresponds to an integer multiple of a period T, in a quantized normalized coefficient sequence $X_Q(\mathbf{1}), \ldots, X_Q(N)$, and sample group Gr2 made up of samples in the quantized normalized coefficient sequence $X_Q(\mathbf{1}), \ldots, X_Q(N)$ that are not included in sample group Gr1 are (separately) encoded in accordance with different encoding criteria.

<<Examples of Sample Groups Gr1 and Gr2>>

Sample group Gr1 is a set $\{X_Q(k) | k \in G\mathbf{1}(T)$ and $k \in \{1, \ldots, N\}\}$ made up of samples $X_Q(k)$ corresponding to indices $k \in G\mathbf{1}(T)$ included in a set $G\mathbf{1}(T)$ which is $G\mathbf{1}(T_f)$ in which $T_f = T$. Sample group Gr2 in this case is a set $\{X_Q(i) | i \in \{1, \ldots, N\} \backslash G\mathbf{1}(T)\}$ made up of samples $X_Q(i)$ that correspond to indices $i \in \{1, \ldots, N\} \backslash G\mathbf{1}(T)$ that are not included in the set $G\mathbf{1}(T)$ in the set of indices $\{1, \ldots, N\}$.

For example if the period T is an integer and $G\mathbf{1}(T) = \{T, 2T, 3T, \ldots, V_{max} \times T\}$, then $Gr\mathbf{1} = \{X_Q(T), X_Q(2T), X_Q(3T), \ldots, X_Q(V_{max} \times T)\}$ and $Gr\mathbf{2} = \{X_Q(\mathbf{1}), \ldots, X_Q(T-1), X_Q(T+1), \ldots, X_Q(2T-1), X_Q(2T+1), \ldots, X_Q(V_{max} \times T-1), X_Q(V_{max} \times T+1), \ldots, X_Q(N)\}$. For example, if the period T is an integer and $G\mathbf{1}(T) = \{T-1, T, T+1, 2T-1, 2T, 2T+1, \ldots V_{max} \times T-1, V_{max} \times T, V_{max} \times T+1\}$, then $Gr\mathbf{1} = \{X_Q(T-1), X_Q(T), X_Q(T+1), X_Q(2T-1), X_Q(2T), X_Q(2T+1), \ldots, X_Q(V_{max} \times T-1), X_Q(V_{max} \times T), X_Q(V_{max} \times T+1)\}$ and $Gr\mathbf{2} = \{X_Q(\mathbf{1}), \ldots, X_Q(T-2), X_Q(T+2), \ldots, X_Q(2T-2), X_Q(2T+2), \ldots, X_Q(V_{max} \times T-2), X_Q(V_{max} \times T+2), \ldots, X_Q(N)\}$. For example, if the period T is a positive decimal fraction and $G\mathbf{1}(T) = \{R(T), R(2T), R(3T), \ldots, R(V_{max} \times T)\}$, then $Gr\mathbf{1} = \{X_Q(R(T)), X_Q(R(2T)), X_Q(R(3T)), \ldots, X_Q(R(V_{max} \times T))\}$ and $Gr\mathbf{2} = \{X_Q(\mathbf{1}), \ldots, X_Q(R(T)-1), X_Q(R(T)+1), \ldots, X_Q(R(2T)-1), X_Q(R(2T)+1), \ldots, X_Q(R(V_{max} \times T)-1), X_Q(R(V_{max} \times T)+1), \ldots, X_Q(n)\}$. For example, if the period T is a positive decimal fraction and $G\mathbf{1}(T) = \{R(T-1), R(T), R(T+1), R(2T-1), R(2T), R(2T+1), \ldots, R(V_{max} \times T-1)\ R(V_{max} \times T), R(V_{max} \times T+1)\}$, then $Gr\mathbf{1} - \{X_Q(R(T-1)), X_Q(R(T)), X_Q(R(T+1)), X_Q(R(2T-1))), X_Q(R(2T)), X_Q(R(2T+1)), \ldots, X_Q(R(V_{max} \times T-1)), X_Q(R(V_{max} \times T)), X_Q(R(V_{max} \times T+1))\}$ and $Gr\mathbf{2} = \{X_Q(\mathbf{1}), \ldots, X_Q(R(T-1)-1), X_Q(R(T+1)+1), \ldots, X_Q(R(2T-1)-1), X_Q(R(2T+1)+1), \ldots, X_Q(R(V_{max} \times T-1)-1), X_Q(R(V_{max} \times T+1)+1), \ldots, X_Q(N)\}$.

Note that a set $G\mathbf{1}(T)$ may be set in accordance with the same interval criterion as that for a set $G\mathbf{1}(T_f)$ for obtaining an indicator S or may be set in accordance with an interval criterion different from an interval criterion for the set $G\mathbf{1}(T_f)$ for obtaining an indicator S. For example, $G\mathbf{1}(T_f)$ may be set in accordance with interval criterion 1 and $G\mathbf{1}(T)$ may be set in accordance with interval criterion 2. Specifically, if $G\mathbf{1}(T_f)$ is $\{T_f, 2T_f, 3T_f, \ldots, V_{max} \times T_f\}$, $G\mathbf{1}(T)$ may be $\{T-1, T, T+1, 2T-1, 2T, 2T+1, \ldots, V_{max} \times T-1, V_{max} \times T, V_{max} \times T+1\}$. Alternatively, the indicator S may be obtained by a method different from the methods described previously and the set $G\mathbf{1}(T)$ may be set in accordance with any of the interval criteria described previously. Further, the number of samples included in each sample group making up sample group Gr1 and sample indices may be variable, or information representing one combination selected from among different combinations of the number of samples included in each of sample groups making up sample group Gr1 and indices may be output as supplementary information.

<<Example of Periodicity-Based Encoding Method>>

The samples included in sample group Gr1 have larger amplitudes than the samples included in sample group Gr2 on average. In view of this, the samples included in sample group Gr1 are encoded using variable-length encoding in accordance with an encoding criterion corresponding to the magnitudes of the amplitudes or estimated magnitudes of the amplitudes of the samples included in sample group Gr1 and the samples included in sample group Gr2 are encoded using variable-length encoding in accordance with an encoding criterion corresponding to the magnitudes of the amplitudes or estimated magnitudes of the amplitudes of the samples included in sample group Gr2. With this configuration, the average code amount of a variable-length code can be reduced because a higher accuracy of estimation of the amplitudes of samples can be achieved than a configuration in which all of the samples included in the sample string are encoded using variable-length encoding in accordance with the same encoding criterion. In other words, encoding sample group Gr1 and sample group Gr2 in accordance with different encoding criteria has the effect of reducing the amount of the code of the sample string. Examples of the magnitude of amplitude include the absolute value of amplitude and the energy of amplitude.

<<Example of Rice Encoding>>

An example will be described in which sample-by-sample Rice encoding is used as variable-length encoding.

In this variable-length encoding, a Rice parameter corresponding to the magnitude of the amplitude or an estimated magnitude of the amplitude of each of the samples included in sample group Gr1 is used to encode the samples included in sample group Gr1 on a sample-by-sample basis using Rice encoding. A Rice parameter corresponding to the magnitude of the amplitude or an estimated magnitude of the amplitude of each of the samples included in sample group Gr2 is used to encode the samples included in sample group Gr2 on a sample-by-sample basis using Rice encoding. Code strings obtained by the Rice encoding and supplementary information for identifying the Rice parameters are output.

For example, a Rice parameter for sample group Gr1 in each frame is obtained from the average of the magnitudes of amplitudes of the samples included in sample group Gr1 in the frame. For example, a Rice parameter for sample group Gr2 in each frame is obtained from the average of the magnitudes of amplitudes of the samples included in sample group Gr2 in the frame. The Rice parameters are integers greater than or equal to 0. The rice parameter for sample group Gr1 in each frame is used to encode the samples included in sample group Gr1 in the frame by Rice encoding; the rice parameter for sample group Gr2 is used to encode the samples included in sample group Gr2 in the frame by Rice encoding. This enables reduction of the average amount of code. This will be described in detail.

First, an example will be described in which the samples included in sample group Gr1 are encoded on a sample-by-sample basis using Rice encoding. A code that is obtained by Rice encoding of the samples $X_Q(k)$ included in sample group Gr1 on a sample-by-sample basis includes prefix(k) resulting from unary encoding of a quotient q(k) obtained by dividing the sample $X_Q(k)$ by a value corresponding to the Rice parameter s for sample group Gr1 and sub(k) that identifies the remainder. To put it plainly, the code corresponding to a sample $X_Q(k)$ in this example includes prefix (k) and sub(k). Samples $X_Q(k)$ to be encoded using Rice encoding are integer representations.

Methods for calculating q(k) and sub(k) will be described below.

If the Rice parameter s>0, the quotient q(k) is generated as follows. Here, floor(χ) is the maximum integer less than or equal to χ.

$$q(k)=\text{floor}(X_Q(k)/2^{s-1})\ (\text{for } X_Q(k)\geq 0) \tag{B1}$$

$$q(k)=\text{floor}\{(-X_Q(k)-1)/2^{s-1}\}\ (\text{for } X_Q(k)<0) \tag{B2}$$

If the Rice parameter s=0, the quotient q(k) is generated as follows.

$$q(k)=2\times X_Q(k)\ (\text{for } X_Q(k)\geq 0) \tag{B3}$$

$$q(k)=-2\times X_Q(k)-1\ (\text{for } X_Q(k)<0) \tag{B4}$$

If the Rice parameter s>0, sub(k) is generated as follows.

$$\text{sub}(k)=X_Q(k)-2^{s-1}\times q(k)+2^{s-1}\ (\text{for } X_Q(k)\geq 0) \tag{B5}$$

$$\text{sub}(k)=(-X_Q(k)-1)-2^{s-1}\times q(k)\ (\text{for } X_Q(k)\leq O) \tag{B6}$$

If the Rice parameter s=0, sub(k) is null (sub(k)=null).

Equations (B1) to (B4) can be generalized to represent the quotient q(k) as follows. Here, |•| represents the absolute value of •.

$$q(k)=\text{floor}\{(2\times|X_Q(k)|-z)/2^s\}\ (z=0 \text{ or } 1 \text{ or } 2) \tag{B7}$$

In Rice encoding, prefix(k) is a code resulting from unary encoding of quotient q(k) and the amount of the code can be expressed using Equation (B7) as $$\text{floor}\{(2\times|X_Q(k)|-z)/2^s\}+1 \tag{B8}$$

In Rice encoding, sub(k) identifying the remainder of each of Equations (B5) and (B6) is represented by s bits. Accordingly, the total code amount C(s, $X_Q$(k), Gr1) of code (prefix(k) and sub(k)) corresponding to the samples $X_Q$(k) included in sample group Gr1 can be written as:

[Equation 6]

$$C(s, X_Q(k), Gr1) = \sum_{k\in Gr1} [\text{floor}\{(2\times|X_Q(k)|-z)/2^s\}+1+s] \tag{B9}$$

Here, by approximating as floor$\{(2\times|X_Q(k)|-z)/2^s\}=(2\times|X_Q(k)|-z)/2^s$, Equation (B9) can be approximated as

[Equation 7]

$$C(s, X_Q(k), Gr1) = 2^{-s}(2\times D - z\times|Gr1|)+(1+s)\times|Gr1| \tag{B10}$$
$$D = \sum_{k\in Gr1} |X_Q(k)|$$

where |Gr1| represents the number of the samples $X_Q$(k) included in sample group Gr1 in one frame.

Let s that yields 0 as the result of partial differentiation with respect to s in Equation (10) be denoted by s':

$$s'=\log_2\{\ln 2\times(2\times D/|Gr1|-z)\} \tag{B11}$$

If D/|Gr1| is sufficiently greater than z, Equation (B11) can be approximated as $$s'=\log_2\{\ln 2\times(2\times D/|Gr1|)\} \tag{B12}$$

Since s' obtained according to Equation (B12) is not an integer, s' is quantized to an integer and the integer is used as the Rice parameter s. The Rice parameter s corresponds to the average D/|Gr1| of the magnitudes of amplitudes of the samples included in sample group Gr1 (see Equation (B12)) and minimizes the total code amount of the code corresponding to the samples $X_Q$(k) included in sample group Gr1.

The foregoing also applies to Rice encoding of the samples included in sample group Gr2. Thus, the total code amount can be minimized by obtaining a Rice parameter for sample group Gr1 from the average of the magnitudes of amplitudes of the samples included in sample group Gr1 in each frame, obtaining a Rice parameter for sample group Gr2 from the average of the magnitudes of amplitudes of the samples included in sample group Gr2, and performing Rice encoding of sample group Gr1 and sample group Gr2 separately.

Smaller variations in the magnitudes of amplitudes of samples $X_Q$(k) result in more appropriate evaluation of the total code amount C(s, $X_Q$(k), Gr1) obtained in accordance with approximated Equation (B10). Accordingly, especially when the magnitudes of amplitudes of the samples included in sample group Gr1 are substantially uniform and the magnitudes of amplitudes of the samples included in sample group Gr2 are substantially uniform, the amount of code can be more significantly reduced.

[Method for Calculating an Estimated Number of Bits of an Integer Signal Code Estimated with the Assumption that a Periodicity-Based Encoding Method is Used as Variable-Length Encoding]

An exemplary method for calculating an estimated number c of bits of an integer signal code with the assumption that a periodicity-based encoding method is used as variable-length encoding will be described next. For example, when sample-by-sample Rice encoding is used as variable-length encoding, the total code amount can be estimated from Rice parameters and the number of samples by calculating a preferable Rice parameter s1 for sample group Gr1 and a preferable Rice parameter s2 for sample group Gr2 and assuming that values of the samples follow a certain exponential distribution, instead of having to actually performing variable-length encoding. Specifically, D in Equation (B10) may be replaced with a value ~D1 estimated with the assumption that the values of samples $X_Q$(k) included in sample group Gr1 follow an exponential distribution and s may be replaced with s1 to obtain ~C(s1, $X_Q$(k), Gr1) as the estimated value of the amount of code of sample group Gr1. For example, the estimated value ~D1 is a value obtained by multiplying an expected value of a sample that follows the exponential distribution by the number of samples $X_Q$(k) included in sample group Gr1. An estimated value of the amount of code of sample group Gr2 may be obtained in a similar manner: Gr1 in Equation (B10) is replaced with Gr2, D is replaced with a value ~D2 estimated with the assumption that the values of samples $X_Q$(k) included in sample group Gr2 follow the exponential distribution, s is replaced with s2 to obtain an estimated value ~C(s2, $X_Q$(i), Gr2) as the estimated value of the amount of code of sample group Gr2. For example, the estimated value ~D2 is a value obtained by multiplying an expected value of a sample that follows the exponential distribution by the number of samples $X_Q$(i) included in sample group Gr2. Therefore, an estimated value of the amount of the code (an estimated number c of bits) of the input quantized normalized coefficient sequence $X_Q$(1), . . . , $X_Q$(N) that is estimated with the assumption that the quantized normalized coefficient sequence $X_Q$(1), . . . , $X_Q$(N) is encoded using the periodicity-based encoding method is the sum of the estimated values of the amounts of code, $\tilde{C}(s1, X_Q(k), Gr1)+\tilde{C}(s2, X_Q(i), Gr2)$ (where $X_Q(k) \in Gr1$ and $X_Q(i) \in Gr2$).

<Determiner 1104>

When the number of updates of gain is equal to a predetermined number of updates or when the estimated number c of bits output from the first periodicity-based variable-length code amount estimator 1103 is equal to the number B of allocated bits, the determiner 1104 outputs the quantized normalized coefficient sequence $X_Q(1), \ldots, X_Q(N)$ and the estimated number c of bits that are input from the first periodicity-based variable-length code amount estimator 1103. The estimated number c of bits output from the determiner 1104 is a "first periodicity-based code amount estimated value $c_{H1}$".

The quantized normalized coefficient sequence $X_Q(1), \ldots, X_Q(N)$ output from the determiner 1104 is input into the second non-periodicity-based variable-length code amount estimator 1120 and the comparison and selection encoder 1300. A first periodicity-based code amount estimated value $c_{H1}$, which is the estimated number of bits output from the determiner 1104, is also input into the comparison and selection encoder 1300.

When the number of updates of the gain is smaller than the predetermined number of updates and the estimated number c of bits output from the first periodicity-based variable-length code amount estimator 1103 is greater than the number B of allocated bits, the determiner 1104 performs control to cause the minimum gain setter 1105 to perform the next process; when the number of updates of the gain is smaller than the predetermined number of updates and the estimated number c of bits is smaller than the number B of allocated bits, the determiner 1104 performs control to cause the maximum gain setter 1109 to perform the next process.

<Minimum Gain Setter 1105>

The minimum gain setter 1105 sets the current value of the gain g as the lower bound $g_{min}$ of the gain ($g_{min} \leftarrow g$). The lower bound $g_{min}$ of the gain represents the minimum allowable value of the gain.

<First Branching Unit 1106>

After the process performed by the minimum gain setter 1105, the first branching unit 1106 performs control to cause the first gain updater 1107 to perform the next process if the upper bound $g_{max}$ of the gain has been already set; otherwise, the first branching unit 1106 performs control to cause the gain increaser 1108 to perform the next process. In addition, the first branching unit 1106 adds 1 to the number of updates of gain.

<First Gain Updater 1107>

The first gain updater 1107 sets the average between the current value of the gain g and the upper bound $g_{max}$ of the gain, for example, as a new value of the gain g ($g \leftarrow (g+g_{max})/2$). This is because an optimum value of the gain is between the current value of the gain g and the upper bound $g_{max}$ of the gain. Since the current value of the gain g has been set as the lower bound $g_{min}$ of the gain, it can be also said that the average between the upper bound $g_{max}$ of the gain and the lower bound $g_{min}$ of the gain is set as a new value of the gain g ($g \leftarrow (g_{max}+g_{min})/2$). The set new gain g is input into the frequency-domain-sequence quantizer 1102.

<Gain Increaser 1108>

The gain increaser 1108 sets a value greater than the current value of the gain g as a new value of the gain g. For example, the gain increaser 1108 sets the current value of the gain g plus an amount Δg by which gain is to be changed, which is a predetermined positive value, as a new value of the gain g ($g \leftarrow g+\Delta g$). Further, for example, when it is found a plurality of successive times that the estimated number c of bits is greater than the number B of allocated bits without upper bound $g_{max}$ of the gain being set, the gain increaser 1108 uses a value greater than the predetermined value as the amount Δg by which the gain is to be changed. The set new gain g is input into the frequency-domain-sequence quantizer 1102.

<Maximum Gain Setter 1109>

The maximum gain setter 1109 sets the current value of the gain g as the upper bound $g_{max}$ of the gain ($g_{max} \leftarrow g$). The upper bound $g_{max}$ of the gain represents the maximum allowable value of the gain.

<Second Branching Unit 1110>

After the process by the maximum gain setter 1109, the second branching unit 1110 performs control to cause the second gain updater 1111 to perform the next process if the lower bound $g_{min}$ of the gain has been already set; otherwise, the second branching unit 1110 performs control to cause the gain reducer 1112 to perform the next process. In addition, the second branching unit 1110 adds 1 to the number of updates of gain.

<Second Gain Updater 1111>

The second gain updater 1111 sets the average between the current value of the gain g and the lower bound $g_{min}$ of the gain as a new value of the gain g ($g \leftarrow (g+g_{min})/2$). This is because an optimum value of the gain is between the current value of the gain g and the lower bound $g_{min}$ of the gain. Since the current value of the gain g has been set as the upper bound $g_{max}$ of the gain, it can be also said that the average between the upper bound $g_{max}$ of the gain and the lower bound $g_{min}$ of the gain is set as a new value of the gain g. ($g \leftarrow (g_{max}+g_{min})/2$). The set new gain g is input into the frequency-domain-sequence quantizer 1102.

<Gain Reducer 1112>

The gain reducer 1112 sets a value smaller than the current value of the gain g as a new value of the gain g. For example, the gain reducer 1112 sets the current value of the gain g minus an amount Δg by which gain is to be changed, which is a predetermined positive value, as a new value of the gain g ($g \leftarrow g-\Delta g$). Further, for example, when it is found a plurality of successive times that the estimated number c of bits is smaller than the number B of allocated bits without lower bound $g_{min}$ of the gain being set, the gain reducer 1112 uses a value greater than the predetermined value as the amount Δg by which the gain is to be changed. The set new gain g is input into the frequency-domain-sequence quantizer 1102.

<Second Non-Periodicity-Based Variable-Length Code Amount Estimator 1120 (FIG. 2)>

The process by the second non-periodicity-based variable-length code amount estimator 1120 is performed when it is determined by the periodicity analyzer 1004 or the like that the indicator S of the degree of periodicity is greater than the predetermined threshold TH (periodicity is high). The second non-periodicity-based variable-length code amount estimator 1120 obtains an estimated value of the code amount (an estimated number of bits) of an integer signal code that corresponds to the quantized normalized coefficient sequence $X_Q(1), \ldots, X_Q(N)$ output from the periodicity-based gain adjustment code amount estimator 1100 (i.e. an integer value sequence obtained by the periodicity-based gain adjustment code amount estimator 1100) with the assumption that the quantized normalized coefficient sequence $X_Q(1), \ldots, X_Q(N)$ is encoded using a non-periodicity-based variable-length encoding method, and outputs the estimated number of bits. The estimated value of the code amount is referred to as the "second non-periodicity-based code amount estimated value $c_{L2}$" since the estimated number of bits output from the second non-periodicity-based variable-length code amount estimator 1120 is an estimated value of the amount of code of an encoding method that does not use periodicity. The second non-periodicity-based code amount estimated value $c_{L2}$, which is the estimated number of bits output from the second non-periodicity-based variable-length code amount estimator 1120, is input into the comparison and selection encoder 1300.

[Method for Calculating an Estimated Number of Bits of an Integer Signal Code with the Assumption that a Non-Periodicity Based Encoding Method is Used as Variable-Length Encoding]

An example of a method for calculating an estimated number of bits of an integer signal code with the assumption that a non-periodicity-based encoding method is used as variable-length encoding will be described. In the example described here, an estimated value of the amount of code that is estimated with the assumption that an input quantized normalized coefficient sequence $X_Q(1), \ldots, X_Q(N)$ is encoded using Rice encoding. For example, sample group Gr1 in Equation (B10) may be replaced with the entire sample string Gr constituted by an input quantized normalized coefficient sequence $X_Q(1), \ldots, X_Q(N)$, D may be replaced with an estimated value ~D estimated with the assumption that the values of the samples $X_Q(n)$ (where n=1, . . . , N) included in the input quantized normalized coefficient sequence $X_Q(1), \ldots, X_Q(N)$ follow an exponential distribution, and ~C(s, $X_Q(n)$, Gr) which is obtained using a preferable Rice parameter s for the entire sample string Gr may be obtained as the estimated value of the code amount (an estimated value of the code amount of an integer signal code that is estimated with the assumption that the integer value sequence is encoded using the non-periodicity-based encoding method). For example, the estimated value ~D is a value obtained by multiplying an expected value of a sample that follows the exponential distribution by the number N of $X_Q(n)$ included in the entire sample string Gr.

<Non-Periodicity-Based Gain Adjustment Code Amount Estimator 1200 (FIG. 2)>

A process by the non-periodicity-based gain adjustment code amount estimator 1200 is performed when it is determined by the periodicity analyzer 1004 or the like that the indicator S is less than or equal to the predetermined threshold TH (periodicity is low). The non-periodicity-based gain adjustment code amount estimator 1200 takes the input of the weighted normalized MDCT coefficient string $X_N(1), \ldots, X_N(N)$ and adjusts the gain g by a gain loop process to obtain and output a quantized normalized coefficient sequence $X_Q(1), \ldots, X_Q(N)$ such that the estimated value (the estimated number of bits) of the code amount estimated with the assumption that the quantized normalized coefficient sequence $X_Q(1), \ldots, X_Q(N)$ is encoded using a "non-periodicity-based encoding method" is less than or equal to the number B of allocated bits, which is the number of bits allocated in advance, and as large as possible. The quantized normalized coefficient sequence $X_Q(1), \ldots, X_Q(N)$ is equivalent to an "integer value sequence which is a string of integer value samples which are obtained by dividing each sample in a frequency-domain sample string by the gain". The non-periodicity-based gain adjustment code amount estimator 1200 outputs the estimated number of bits (i.e. the estimated value of the code amount of the integer signal code estimated with the assumption that the integer value sequence is encoded using the non-periodicity-based encoding method). The estimated value of the amount of code is referred to as the "first non-periodicity-based code amount estimated value $c_{L1}$" since the estimated number of bits output from the non-periodicity-based gain adjustment code amount estimator 1200 is an estimate value of the amount of code of an encoding method that does not use periodicity. That is, the non-periodicity-based gain adjustment code amount estimator 1200 differs from the periodicity-based gain adjustment code amount estimator 1100 in that whereas the periodicity-based gain adjustment code amount estimator 1100 obtains an "estimated number of bits estimated with the assumption that the periodicity-based encoding method is used", the non-periodicity-based gain adjustment code amount estimator 1200 obtains an "estimated number of bits estimated with the assumption that the non-periodicity-based encoding method is used".

Figure 4:
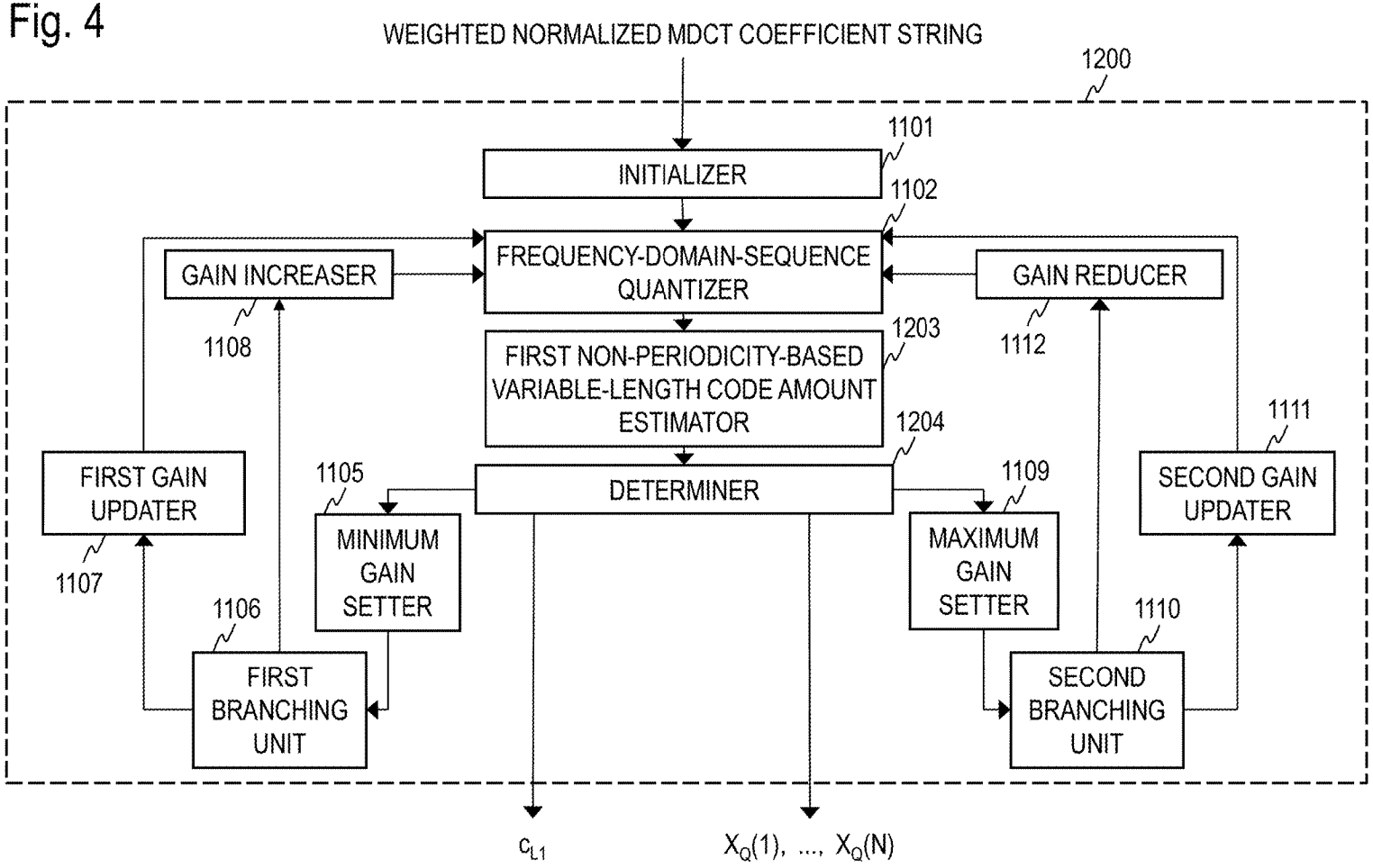
FIG. 4 is a block diagram illustrating an exemplary configuration of a non-periodicity-based gain adjustment code amount estimator according to the first embodiment.

FIG. 4 illustrates a detailed exemplary configuration of the non-periodicity-based gain adjustment code amount estimator 1200. The non-periodicity-based gain adjustment code amount estimator 1200 is identical with the periodicity-based gain adjustment code amount estimator 1100 except that the first periodicity-based variable-length code amount estimator 1103 is replaced with a first non-periodicity-based variable-length code amount estimator 1203 and the determiner 1104 is replaced with a determiner 1204. Accordingly, the functions of the other parts of the non-periodicity-based gain adjustment code amount estimator 1200 are the same as the functions of the counterparts of the periodicity-based gain adjustment code amount estimator 1100 with the difference being that an estimated value of the code amount (a non-periodicity-based code amount estimated value) output from the first non-periodicity-based variable-length code amount estimator 1203 is used instead of an estimated value of the code amount (a periodicity-based code amount estimated value) output from the first periodicity-based variable-length code amount estimator 1103. Therefore, the processing parts that perform in principle the same processes as those of the periodicity-based gain adjustment code amount estimator 1100 are given the same names and reference numerals. Note that the processing parts that are given the same names and reference numerals may be physically the same processing parts or may be physically different processing parts. The following description will focus on processes that are different from those of the periodicity-based gain adjustment code amount estimator 1100.

<First Non-Periodicity-Based Variable-Length Code Amount Estimator 1203 (FIG. 4)>

The first non-periodicity-based variable-length code amount estimator 1203 obtains an estimated value (an estimated number of bits) c of the code amount of an integer signal code that corresponds to the quantized normalized coefficient sequence $X_Q(1), \ldots, X_Q(N)$ output from the frequency-domain sequence quantizer 1102 with the assumption that the quantized normalized coefficient sequence $X_Q(1), \ldots, X_Q(N)$ is encoded using a non-periodicity-based encoding method as variable-length encoding, and outputs the estimated number c of bits and the quantized normalized coefficient sequence $X_Q(1), \ldots, X_Q(N)$. The estimated number c of bits and the quantized normalized coefficient sequence $X_Q(1), \ldots, X_Q(N)$ output from the first non-periodicity-based variable-length code amount estimator 1203 are input into the determiner 1204. An example of the non-periodicity-based variable-length encoding method is the same as the method described in the section on the second non-periodicity-based variable-length code amount estimator 1120.

The first non-periodicity-based variable-length code amount estimator 1203 differs from the second non-periodicity-based variable-length code amount estimator 1120 in that whereas the first non-periodicity-based variable-length code amount estimator 1203 estimates the code amount of the quantized normalized coefficient sequence $X_Q(1), \ldots, X_Q(N)$ output from the frequency-domain-sequence quantizer 1102, the second non-periodicity-based variable-length code amount estimator 1120 estimates the code amount of the quantized normalized coefficient sequence $X_Q(1), \ldots, X_Q(N)$ output from the periodicity-based gain adjustment code amount estimator 1100 and that the first non-periodicity-based variable-length code amount estimator 1203 outputs the quantized normalized coefficient sequence $X_Q(1), \ldots, X_Q(N)$ in addition to the estimated number c of bits.

<Determiner 1204>

When the number of updates of gain is equal to a predetermined number of updates or when the estimated number c of bits (non-periodicity-based code amount estimated value) output from the first non-periodicity-based variable-length code amount estimator 1203 is equal to the number B of allocated bits, the determiner 1204 outputs the quantized normalized coefficient sequence $X_Q(1), \ldots, X_Q(N)$ and the estimated number c of bits. The estimated number c of bits is a "first non-periodicity-based code amount estimated value $c_{L1}$".

The quantized normalized coefficient sequence $X_Q(1), \ldots, X_Q(N)$ output from the determiner 1204 is input into the second periodicity-based variable-length code amount estimator 1220 and the comparison and selection encoder 1300. The first non-periodicity-based code amount estimated value $c_{L1}$, which is the estimated number of bits output from the determiner 1204, is input into the comparison and selection encoder 1300.

When the number of updates of the gain is smaller than the predetermined number of updates and the estimated number c of bits output from the first non-periodicity-based variable-length code amount estimator 1203 is greater than the number B of allocated bits, the determiner 1204 performs control to cause the minimum gain setter 1105 to perform the process described previously; when the number of updates of the gain is smaller than the predetermined number of updates and the estimated number c of bits is smaller than the number B of allocated bits, the determiner 1204 performs control to cause the maximum gain setter 1109 to perform the process described previously. The subsequent processes performed by the minimum gain setter 1105, the first branching unit 1106, the first gain updater 1107, the gain increaser 1108, the maximum gain setter 1109, the second branching unit 1110, the second gain updater 1111, and the gain reducer 1112 are as described in the section on the periodicity-based gain adjustment code amount estimator 1100 (FIG. 2).

<Second Periodicity-Based Variable-Length Code Amount Estimator 1220 (FIG. 2)>

A process by the second periodicity-based variable-length code amount estimator 1220 is performed when it is determined by the periodicity analyzer 1004 or the like that the indicator S is lower than or equal to the predetermined threshold TH (periodicity is low). The second periodicity-based variable-length code amount estimator 1220 takes the inputs of the quantized normalized coefficient sequence $X_Q(1), \ldots, X_Q(N)$ output from the non-periodicity-based gain adjustment code amount estimator 1200 and the period T output from the periodicity analyzer 1004 and obtains an estimated value of the code amount (an estimated number of bits) of an integer signal code that corresponds to the quantized normalized coefficient sequence $X_Q(1), \ldots, X_Q(N)$ with the assumption that the quantized normalized coefficient sequence $X_Q(1), \ldots, X_Q(N)$ is encoded using the periodicity based encoding method as variable-length encoding and outputs the estimated number of bits. The estimated number of bits is referred to as the "second periodicity-based code amount estimated value $c_{H2}$" since the estimated number of bits output from the second periodicity-based variable-length code amount estimator 1220 is an estimated value of the code amount of an encoding method that uses periodicity. The second periodicity-based code amount estimated value $c_{H2}$, which is the estimated number of bits output from the second periodicity-based variable-length code amount estimator 1220, is input into the comparison and selection encoder 1300. An example of the periodicity-based encoding method is the same as that described in the section on the first periodicity-based variable-length code amount estimator 1103.

The second periodicity-based variable-length code amount estimator 1220 differs from the first periodicity-based variable-length code amount estimator 1103 in that whereas the first periodicity-based variable-length code amount estimator 1103 estimates the code amount of the quantized normalized coefficient sequence $X_Q(1), \ldots, X_Q(N)$ output from the frequency-domain-sequence quantizer 1102, the second periodicity-based variable-length code amount estimator 1220 estimates the code amount of the quantized normalized coefficient sequence $X_Q(1), \ldots, X_Q(N)$ output from the non-frequency-based gain adjustment code amount estimator 1200 and that the first periodicity-based variable-length code amount estimator 1103 outputs the quantized normalized coefficient sequence $X_Q(1), \ldots, X_Q(N)$ in addition to the first periodicity-based code amount estimated value $c_{H1}$.

[Intent of Periodicity-Based Gain Adjustment Code Amount Estimator 1100 and the Non-Periodicity-Based Gain Adjustment Code Amount Estimator 1200]

The intent of the periodicity-based gain adjustment code amount estimator 1100 and the non-periodicity-based gain adjustment code amount estimator 1200 is to decide the quantized normalized coefficient sequence $X_Q(1), \ldots, X_Q(N)$ and the estimated value of the code amount of the quantized normalized coefficient by performing a gain loop process with the assumption that an encoding method that is expected to result in a smaller amount of code is used. The encoding method assumed in estimating the code amount is decided on the basis of the degree of periodicity (the indicator S of the degree of periodicity) of an input audio signal. When the periodicity of the input audio signal is high, a periodicity-based encoding method is more likely to result in a smaller amount of code and therefore the periodicity-based gain adjustment code amount estimator 1100 performs the gain loop process with the assumption that the periodicity-based encoding method is used. When the periodicity of the input audio signal is low, a non-periodicity-based encoding method is more likely to result in a smaller amount of code and therefore the non-periodicity-based gain adjustment code amount estimator 1200 performs the gain loop process with the assumption that the non-periodicity-based encoding method is used.

[Intent of the Second Non-Periodicity-Based Variable-Length Code Amount Estimator 1120 and the Second Periodicity-Based Variable-Length Code Amount Estimator 1220]

The intent of the second non-periodicity-based variable-length code amount estimator and the second periodicity-based variable-length code amount estimator 1220 is to substitute (use) the quantized normalized coefficient sequence $X_Q(1), \ldots, X_Q(N)$ obtained with the assumption that an encoding method that is expected to result in a smaller code amount is used, thereby obtaining an estimated value of the code amount that would be obtained with the assumption that the other encoding method is used. By avoiding repeating a gain loop process, the amount of computation can be reduced.

<Comparison and Selection Encoder 1300>

An estimated value of the amount of code produced by an encoding method assumed in the gain loop process (i.e. an encoding method expected to result in a smaller code amount), that is, an estimated number of bits output from the periodicity-based gain adjustment code amount estimator 1100 or the non-periodicity-based gain adjustment code amount estimator 1200 will be referred to as the first code amount estimated value $c_1$. An estimated number of bits estimated by substituting the quantized normalized coefficient sequence $X_Q(1), \ldots, X_Q(N)$ obtained with the assumption that an encoding method that is expected to result in a smaller code amount is used, that is, an estimated number of bits that is output from the second non-periodicity-based variable-length code amount estimator 1120 or the second periodicity-based variable-length code amount estimator 1220 will be referred to as the second code amount estimated value $c_2$. In other words, when the indicator S of the degree of periodicity is greater than the predetermined threshold TH (periodicity is high), the first code amount estimated value is $c_1=c_{H1}$ and the second code amount estimated value is $c_2=c_{L2}$. When the indicator S of the degree of periodicity is lower than or equal to the predetermined threshold TH (periodicity is low), the first code amount estimated value is $c_1=c_{L1}$ and the second code amount estimated value is $c_2=c_{H2}$.

The first code amount estimated value $c_1$, the second code amount estimated value $c_2$, the quantized normalized coefficient sequence $X_Q(1), \ldots, X_Q(N)$, the period T and the indictor S of the degree of periodicity are input into the comparison and selection encoder 1300. The comparison and selection encoder 1300 compares the input first code amount estimated value c with the input second code amount estimated value $c_2$ and uses the encoding method assumed when the smaller code amount estimated value has been obtained to encode the input quantized normalized coefficient sequence $X_Q(1), \ldots, X_Q(N)$, thereby obtaining an integer signal code.

Specifically, when the indicator S of the degree of periodicity is greater than the predetermined threshold TH (periodicity is high), the comparison and selection encoder 1300 compares the first periodicity-based code amount estimated value $c_{H1}$ output from the periodicity-based gain adjustment code amount estimator 1100 with the second non-periodicity based code amount estimated value $c_{H2}$ output from the second non-periodicity-based variable-length code amount estimator 1120 and uses the encoding method assumed when the smaller code amount estimated value has been obtained to encode the quantized normalized coefficient sequence $X_Q(1), \ldots, X_Q(N)$ output from the periodicity-based gain adjustment code amount estimator 1100, thereby obtaining an integer signal code. In addition, the comparison and selection encoder 1300 outputs the quantized normalized coefficient sequence $X_Q(1), \ldots, X_Q(N)$ output from the periodicity-based gain adjustment code amount estimator 1100 to the transmission gain encoder 1400.

When the indicator S of the degree of periodicity is lower than the predetermined threshold TH (periodicity is low), the comparison and selection encoder 1300 compares the first non-periodicity-based code amount estimated value $c_{L1}$ output from the non-periodicity-based gain adjustment code amount estimator 1200 with the second periodicity-based code amount estimated value $c_{H2}$ output from the second periodicity-based variable-length code amount estimator 1220 and uses the encoding method assumed when the smaller code amount estimated value has been obtained to encode the quantized normalized coefficient sequence $X_Q(1), \ldots, X_Q(N)$ output from the non-periodicity-based gain adjustment code amount estimator 1200, thereby obtaining an integer signal code. In addition, the comparison and selection encoder 1300 outputs the quantized normalized coefficient sequence $X_Q(1), \ldots, X_Q(N)$ output from the non-periodicity-based gain adjustment code amount estimator 1200 to the transmission gain encoder 1400.

When the "smaller code amount estimated value" is the first periodicity-based code amount estimated value $c_{H1}$ or the second periodicity-based code amount estimated value $c_{H2}$, the "encoding method assumed when the smaller code amount estimated value has been obtained" is the periodicity based encoding method; when the "smaller code amount estimated value" is the first non-periodicity-based code amount estimated value $c_{L1}$ or the second non-periodicity-based code amount estimated value $c_{L2}$, the "encoding method assumed when the smaller code amount estimated value has been obtained" is the non-periodicity based encoding method.

Specifically, when the first periodicity-based code amount estimated value $c_{H1}$ is greater than the second non-periodicity-based code amount estimated value $c_{L2}$, the comparison and selection encoder 1300 uses the non-periodicity based encoding method to encode the quantized normalized coefficient sequence $X_Q(1), \ldots, X_Q(N)$ obtained by the periodicity-based gain adjustment code amount estimator 1100, thereby obtaining an integer signal code. When the first periodicity-based code amount estimated value $c_{H1}$ is smaller than the second non-periodicity-based code amount estimated value $c_{L2}$, the comparison and selection encoder 1300 uses the periodicity based encoding method to encode the quantized normalized coefficient sequence $X_Q(1), \ldots, X_Q(N)$ obtained by the periodicity-based gain adjustment code amount estimator 1100, thereby obtaining an integer signal code. When the first non-periodicity-based code amount estimated value $c_{L1}$ is greater than the second periodicity-based code amount estimated value $c_{H2}$, the comparison and selection encoder 1300 uses the periodicity-based encoding method to encode the quantized normalized coefficient sequence $X_Q(1), \ldots, X_Q(N)$ obtained by the non-periodicity-based gain adjustment code amount estimator 1200, thereby obtaining an integer signal code. When the first non-periodicity-based code amount estimated value $c_{L1}$ is smaller than the second periodicity-based code amount estimated value $c_{H2}$, the comparison and selection encoder 1300 uses the non-periodicity-based encoding method to encode the quantized normalized coefficient sequence $X_Q(1), \ldots, X_Q(N)$ obtained by the non-periodicity-based gain adjustment code amount estimator 1200, thereby obtaining an integer signal code.

Note that when $c_1=c_2$, in principle any of the encoding methods may be used but the encoding method assumed when the first code amount estimated value $c_1$ has been obtained, for example, is preferentially used.

Further, when the number of bits of the integer signal code obtained by encoding the quantized normalized coefficient sequence $X_Q(1), \ldots, X_Q(N)$ exceeds the number B of allocated bits, the comparison and selection encoder 1300 removes the amount of the integer signal code by which the number of bits exceeds the number B of allocated bits (truncation code) from the integer signal code obtained by encoding and outputs the resulting integer signal code. When the number of bits of the integer signal code obtained by encoding the quantized normalized coefficient sequence $X_Q(1), \ldots, X_Q(N)$ does not exceed the number B of allocated bits, the comparison and selection encoder 1300 outputs the integer signal code obtained by encoding without truncation. The integer signal code output from the comparison and selection encoder 1300 is transmitted to the decoder.

[First Modification]

When the "predetermined number of updates" which specifies the upper limit of the number of updates of gain in the gain loop process described above, is large enough, the first code amount estimated value $c_1$ does not exceed the number B of allocated bits because of the processing performed by the periodicity-based gain adjustment code amount estimator 1100 and the non-periodicity-based gain adjustment code amount estimator 1200. On the other hand, the second code amount estimated value $c_2$, which is a code amount estimated by substituting the quantized normalized coefficient sequence $X_Q(1), \ldots, X_Q(N)$ obtained by performing the gain loop process, can exceed the number B of allocated bits.

When the number of bits of the integer signal code obtained by encoding exceeds the number B of allocated bits, code truncation occurs at the comparison and selection encoder 1300 as described above. Quantized normalized coefficients corresponding to the removed portion of the code cannot be decoded at the decoder and the quality of the decoded audio signal decreases accordingly. It is therefore preferable that truncation of code do not occur.

In view of the fact described above, the comparison and selection encoder 1300 may compare the second code amount estimated value $c_2$ with the first code amount estimated value $c_1$ only when the second code amount estimated value $c_2$ does not exceed the number B of allocated bits. In this case, the comparison and selection encoder 1300 performs the following process.

When the second code amount estimated value $c_2$ is less than or equal to the number B of allocated bits and less than the first code amount estimated value $c_1$, the comparison and selection encoder 1300 uses the encoding method assumed when the second code amount estimated value $c_2$ has been obtained to encode the input quantized normalized coefficient sequence $X_Q(1), \ldots, X_Q(N)$, thereby obtaining and outputting an integer signal code. Otherwise, the comparison and selection encoder 1300 uses the encoding method assumed when the first code amount estimated value $c_1$ has been obtained to encode the input quantized normalized coefficient sequence $X_Q(1), \ldots, X_Q(N)$, thereby obtaining and outputting an integer signal code. Specifically, a process for the case of high periodicity and a process for the case of low periodicity are performed as described below.

[When it is Determined that the Indicator S of the Degree of Periodicity is Higher than the Predetermined Threshold TH (Periodicity is High)]

When the second non-periodicity-based code amount estimated value $c_{L2}$ output from the second non-periodicity-based variable-length code amount estimator 1120 is less than or equal to the number B of allocated bits and less than the first periodicity-based code amount estimated value $c_{H1}$, the comparison and selection encoder 1300 encodes the quantized normalized coefficient sequence $X_Q(1), \ldots, X_Q(N)$ output from the periodicity-based gain adjustment estimator 1100 by using the non-periodicity-based variable-length encoding method to obtain an integer signal code. Otherwise, the comparison and selection encoder 1300 encodes the quantized normalized coefficient sequence $X_Q(1), \ldots, X_Q(N)$ output from the periodicity-based gain adjustment estimator 1100 by using the periodicity-based variable-length encoding method to obtain an integer signal code.

[When it is Determined that the Indicator S of the Degree of Periodicity is Lower than or Equal to the Predetermined Threshold TH (Periodicity is Low)]

When the second periodicity-based code amount estimated value $c_{H2}$ output from the second periodicity-based variable-length code amount estimator 1220 is less than or equal to the number B of allocated bits and less than the first non-periodicity-based code amount estimated value $c_{L1}$, the comparison and selection encoder 1300 encodes the quantized normalized coefficient sequence $X_Q(1), \ldots, X_Q(N)$ output from the non-periodicity-based gain adjustment code amount estimator 1200 by using the periodicity-based variable-length encoding method to obtain an integer signal code. Otherwise, the comparison and selection encoder 1300 encodes the quantized normalized coefficient sequence $X_Q(1), \ldots, X_Q(N)$ output from the non-periodicity-based gain adjustment code amount estimator 1200 by using the non-periodicity-based variable-length encoding method to obtain an integer signal code.

[Second Modification]

The periodicity-based encoding method requires the period T for encoding. This means that the period T is required at the decoder as well for decoding and therefore a code corresponding to the period T is transmitted to the decoder. In other words, in the periodicity-based encoding method, the code corresponding to the period T transmitted to the decoder adds to the code amount of the integer signal code obtained by encoding.

In consideration of this, the comparison and selection encoder 1300 may compare the code amount estimated value obtained with the assumption that the periodicity-based encoding method is used plus the code amount c(T) of the code corresponding to the period T with the code amount estimated value obtained with the assumption that the non-periodicity-based encoding method is used.

Specifically, when the indicator S of the degree of periodicity is greater than the predetermined threshold TH (periodicity is high), $c_1+c(T)$ may be compared with $c_2$; when the indicator S of the degree of periodicity is lower than or equal to the predetermined threshold TH (periodicity is low), $c_1$ may be compared with $c_2+c(T)$. In other words, the process "when the first periodicity-based code amount estimated value $c_{H1}=c_1$ is greater than the second non-periodicity-based code amount estimated value $c_{L2}=c_2$" described above may be performed "when the first periodicity-based code amount estimated value $c_1$ plus the code amount c(T), $c_1+c(T)$, is greater than the second non-periodicity-based code amount estimated value $c_2$"; the process "when the first periodicity-based code amount estimated value $c_1$ is less than the second non-periodicity-based code amount estimated value $c_2$" described above may be performed "when the first periodicity-based code amount estimated value $c_1$ plus the code amount c(T), $c_1+c(T)$, is less than the second non-periodicity-based code amount estimated value $c_2$"; and the process "when $c_1=c_2$" described above may be performed "when $c_1+c(T)$ $c_2$". Similarly, the process "when the first non-periodicity-based code amount estimated value $c_{L1}=c_1$ is greater than the second periodicity-based code amount estimated value $c_{H2}=c_2$" described above may be performed "when the first non-periodicity-based code amount estimated value $c_1$ is greater than the second periodicity-based code amount estimated value $c_2$ plus the code amount c(T), $c_2$+c(T)"; the process "when the first non-periodicity-based code amount estimated value $c_1$ is less than the second periodicity-based code amount estimated value $c_2$" described above may be performed "when the first non-periodicity-based code amount estimated value $c_1$ is less than the second periodicity-based code amount estimated value $c_2$ plus the code amount c(T), $c_2$+c(T)"; and the process "when $c_1$=$c_2$" described above may be performed when "$c_1$=$c_2$+c(T)". Alternatively, any of the comparisons that take into account the code amount c(T) of the code corresponding to the period T in this way may be used in the mode described in the section on the first modification.

[Intent of the Comparison and Selection Encoder 1300]

Whereas the periodicity-based gain adjustment code amount estimator 1100 and the non-periodicity-based gain adjustment code amount estimator 1200 are configured so that the estimated number c of bits is smaller than or equal to the number B of allocated bits and is as large as possible, the comparison and selection encoder 1300 selects the first code amount estimated value $c_1$ or the second code amount estimated value $c_2$ which are the estimated number of bits, whichever represents the smaller estimated number of bits. The reason for this will be described below.

The purpose of the periodicity-based gain adjustment code amount estimator 1100 and the non-periodicity-based gain adjustment code amount estimator 1200 is to obtain the quantized normalized coefficient sequence $X_Q(\mathbf{1}), \ldots, X_Q(N)$ with small quantization distortion. The smaller the value of the gain g, the greater the estimated value of the amount of code for a quantized normalized coefficient sequence $X_Q(\mathbf{1}), \ldots, X_Q(N)$ but the smaller the quantization distortion that occurs when the quantized normalized coefficient sequence $X_Q(\mathbf{1}), \ldots, X_Q(N)$ is obtained from the weighted normalized MDCT coefficient string $X_N(\mathbf{1}), \ldots, X_N(N)$. Therefore, the periodicity-based gain adjustment code amount estimator 1100 and the non-periodicity-based gain adjustment code amount estimator 1200 obtain the quantized normalized coefficient sequence $X_Q(\mathbf{1}), \ldots, X_Q(N)$ such that the estimated number of bits is smaller than or equal to the number B of allocated bits and is as large as possible.

The code amount estimated value output from the second non-periodicity-based variable-length code amount estimator 1120 is an estimated value of the code amount for the quantized normalized coefficient sequence $X_Q(\mathbf{1}), \ldots, X_Q(N)$ output from the periodicity-based gain adjustment code amount estimator 1100. That is, the first periodicity-based code amount estimated value $c_{H1}$ output from the periodicity-based gain adjustment code amount estimator 1100 and the second non-periodicity-based code amount estimated value $c_{L2}$ output from the second non-periodicity-based variable-length code amount estimator 1120 are estimated values of the code amount for the same quantized normalized coefficient sequence $X_Q(\mathbf{1}), \ldots, X_Q(N)$. Because with the same degree of quantization distortion, a smaller amount of code is more preferable, the comparison and selection encoder 1300 selects the estimated value that represents a smaller estimated number of bits.

Similarly, since the first non-periodicity-based code amount estimated value $c_{L1}$ output from the non-periodicity-based gain adjustment code amount estimator 1200 and the second periodicity-based code amount estimated value $c_{12}$ output from the second periodicity-based variable-length code amount estimator 1220 are estimated values of the code amount for the same quantized normalized coefficient sequence $X_Q(\mathbf{1}), \ldots, X_Q(N)$, the comparison and selection encoder 1300 selects the estimated value that represents a smaller estimate number of bits.

<Transmission Gain Encoder 1400>

The transmission gain encoder 1400 calculates a transmission gain ^g from a quantized normalized coefficient sequence $X_Q(\mathbf{1}), \ldots, X_Q(N)$ output from the comparison and selection encoder 1300 and a weighted normalized MDCT coefficient string $X_N(\mathbf{1}), \ldots, X_N(N)$ output from the weighted envelope normalizer 1003 and outputs a gain code corresponding to the calculated transmission gain ^g. For example, the transmission gain encoder 1400 encodes a transmission gain ^g obtained by $$\hat{g} = \sqrt{\frac{\sum_{n=1}^{N} X_N(n) X_{Q(n)}}{\sum_{n=1}^{N} |X_Q(n)|^2}} \qquad \text{[Equation 8]}$$

by using a predetermined number of bits to obtain and output a gain code. In short, the transmission gain encoder 1400 obtains and outputs a code corresponding to a quantized value $\hat{g}_Q$ of the transmission gain ^g. The transmission gain ^g is an approximate value (estimated value) of the gain decided as a result of the gain loop process by the periodicity-based gain adjustment encoder or the non-periodicity-based gain adjustment encoder.

Second Embodiment

In the first embodiment, the first periodicity-based variable-length code amount estimator 1103, the second periodicity-based variable-length code amount estimator 1220, the first non-periodicity-based variable-length code amount estimator 1203, and the second non-periodicity-based variable-length code amount estimator 1120 output the code amount estimated values and the comparison and selection encoder 1300 makes the comparison between the input code amount estimated values to select the encoding method and encodes the quantized normalized coefficient sequence $X_Q(\mathbf{1}), \ldots, X_Q(N)$ by using the selected encoding method to obtain and output the integer signal code. However, a comparison can be made between "code amounts obtained by actual encoding", instead of "code amount estimated values". An embodiment in which a comparison is made between "code amounts obtained by actual encoding" will be described below.

Figure 5:
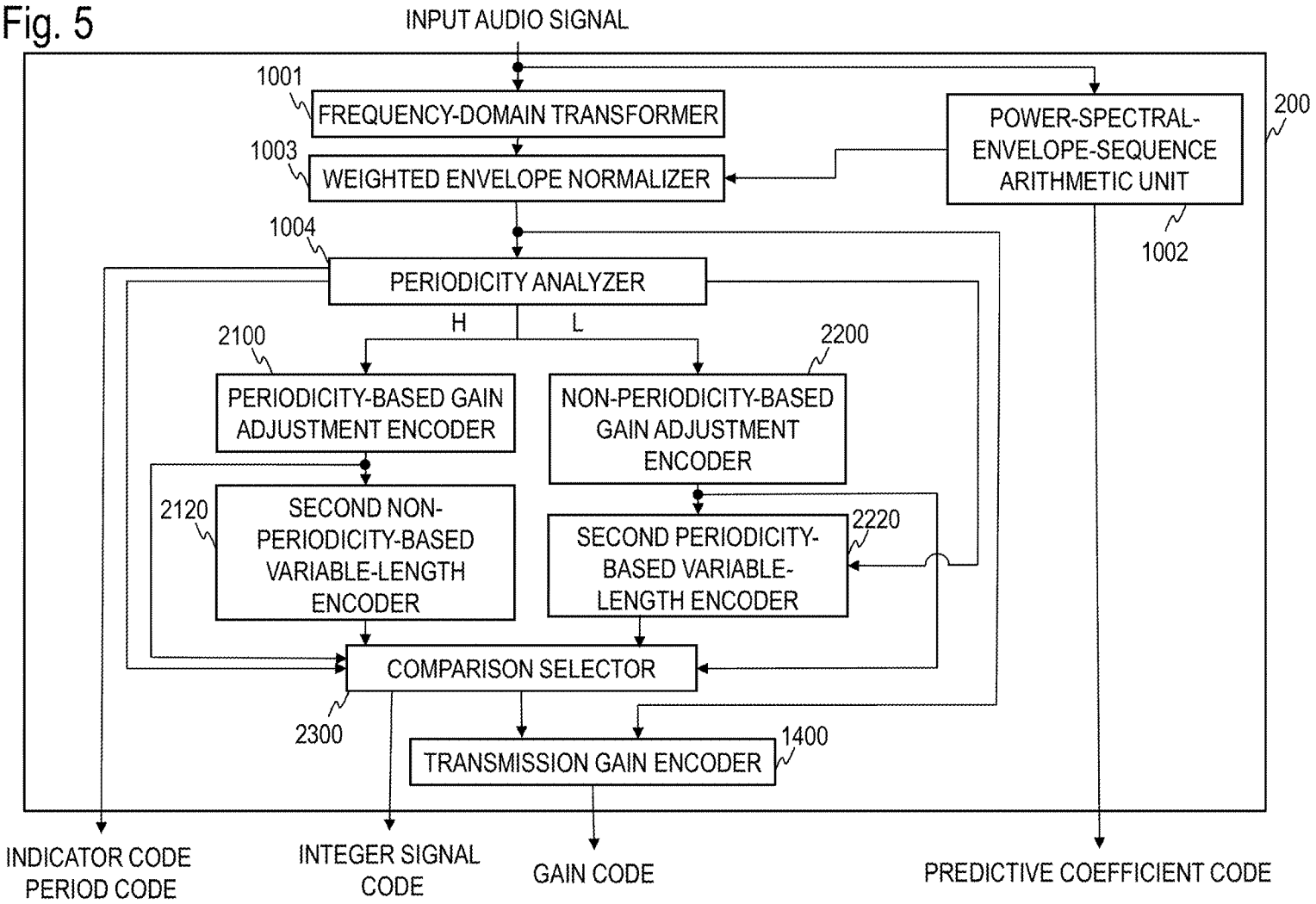
FIG. 5 is a block diagram illustrating an exemplary configuration of an encoder according to a second embodiment.

FIG. 5 illustrates an exemplary configuration of an encoder 200 according to this embodiment. The encoder 200 comprises a periodicity-based gain adjustment encoder 2100, a non-periodicity-based gain adjustment encoder 2200, a second non-periodicity-based variable-length encoder 2120, a second periodicity-based variable-length encoder 2220, and a comparison selector 2300 in place of the periodicity-based gain adjustment code amount estimator 1100, the non-periodicity-based gain adjustment code amount estimator 1200, the second non-periodicity-based variable-length code amount estimator 1120, the second periodicity-based variable-length code amount estimator 1220 and the comparison and selection encoder 1300, respectively, of the encoder 100. The other processing parts of the encoder 200 are the same as those of the encoder 100 except that a periodicity analyzer 1004 does not need to send a period T to the comparison selector 2300 (which replaces the comparison and selection encoder 1300) and that a transmission gain encoder 1400 uses a quantized normalized coefficient sequence $X_Q(1), \ldots, X_Q(N)$ output from the comparison selector 2300. The following description will focus on processes different from those of the encoder 100.

<Periodicity-Based Gain Adjustment Encoder 2100>

A process by the periodicity-based gain adjustment encoder 2100 is performed when it is determined by a periodicity analyzer 1004 or the like that an indicator S is greater than a predetermined threshold TH (periodicity is high). The periodicity-based gain adjustment encoder 2100 takes inputs of the quantized normalized coefficient sequence $X_Q(1), \ldots, X_Q(N)$ and the period T output from the periodicity analyzer 1004 and adjusts the gain g by performing a gain loop process to obtain and output a quantized normalized coefficient sequence $X_Q(1), \ldots, X_Q(N)$ (i.e. a sequence of integer values) such that the number of bits (the code amount) of an integer signal code obtained by encoding the quantized normalized coefficient sequence $X_Q(1), \ldots, X_Q(N)$ using a periodicity based encoding method is less than or equal to the number B of allocated bits, which is the number of bits allocated in advance, and as large as possible. In addition, the periodicity-based gain adjustment encoder 2100 outputs the integer signal code. The code is referred to as the "first periodicity-based integer signal code" since the integer signal code output from the periodicity-based gain adjustment encoder 2100 is a code obtained by encoding using a periodicity-based encoding method.

Figure 6:
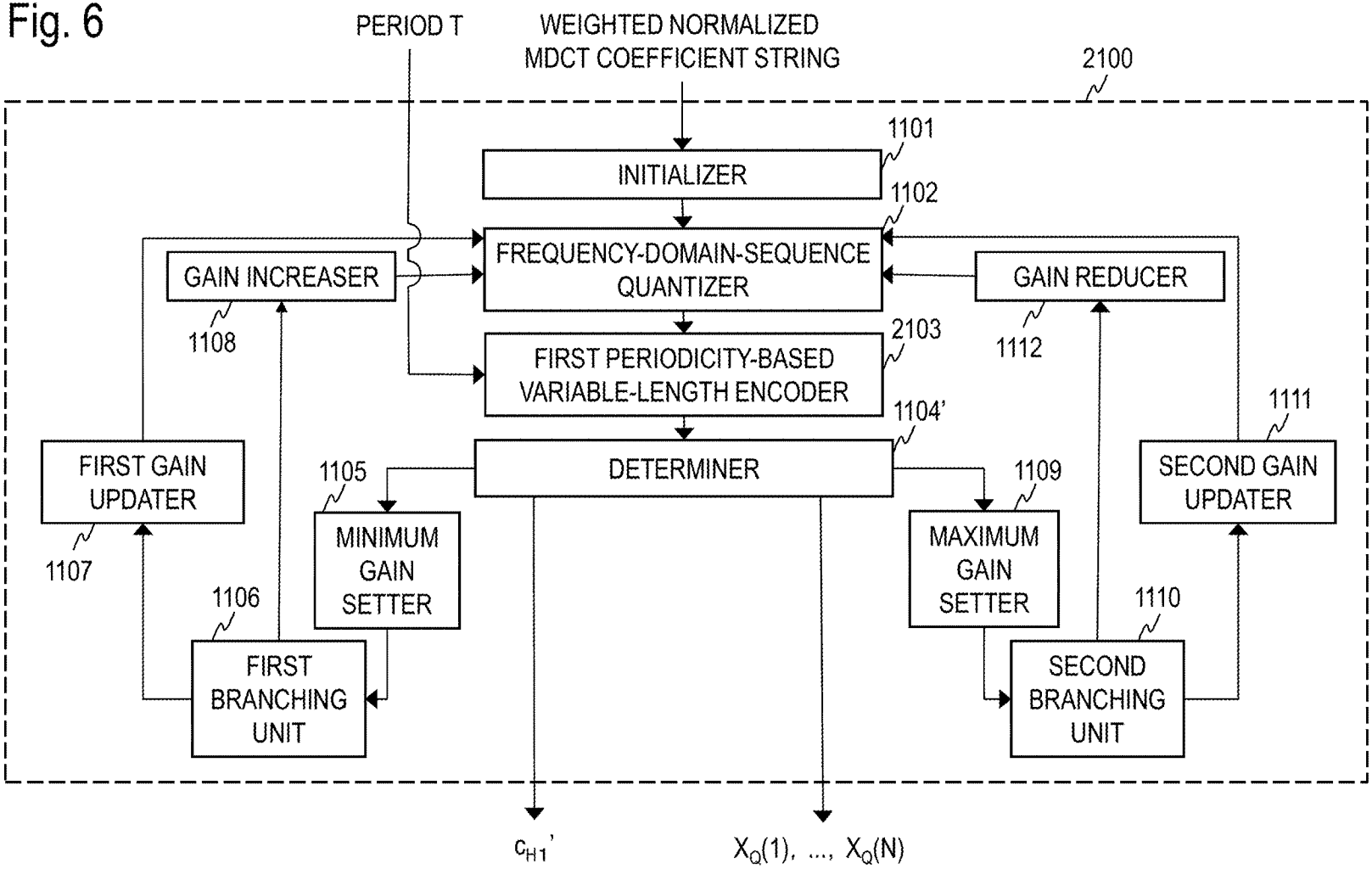
FIG. 6 is a block diagram illustrating an exemplary configuration of a periodicity-based gain adjustment encoder according to the second embodiment.

FIG. 6 illustrates a detailed configuration of the periodicity-based gain adjustment encoder 2100. The periodicity-based gain adjustment encoder 2100 is identical with the periodicity-based gain adjustment code amount estimator 1100 except that the first periodicity-based variable-length code amount estimator 1103 is replaced with a first periodicity-based variable-length encoder 2103 and the determiner 1104 is replaced with a determiner 1104'. Accordingly, the other parts have the same functions as those of the periodicity-based gain adjustment code amount estimator 1100 except that the amount of code of an integer signal code output from the first periodicity-based variable-length encoder 2103 is used instead of a code amount estimated value (a periodicity-based code amount estimated value) output from the first periodicity-based variable-code amount estimator 1103. Therefore, the processing parts that perform in principle the same processes as those in the periodicity-based gain adjustment code amount estimator 1100 are given the same names and reference numerals. The following description will focus on processes that are different from those in the periodicity-based gain adjustment code amount estimator 1100.

<First Periodicity-Based Variable-Length Encoder 2103 (FIG. 6)>

The first periodicity-based variable-length encoder 2103 encodes a quantized normalized coefficient sequence $X_Q(1), \ldots X_Q(N)$ output from a frequency-domain-sequence quantizer 1102 by using a variable-length periodicity based encoding method to obtain an integer signal code corresponding to the quantized normalized coefficient sequence $X_Q(1), \ldots, X_Q(N)$ and outputs the integer signal code and the quantized normalized coefficient sequence $X_Q(1), \ldots, X_Q(N)$. The integer signal code and the quantized normalized coefficient sequence $X_Q(1), \ldots, X_Q(N)$ output from the first periodicity-based variable-length encoder 2103 are input into the determiner 1104'. An example of the periodicity-based encoding method is as described in the section on the first periodicity-based variable-length code amount estimator 1103.

<Determiner 1104'>

When the number of updates of the gain is equal to a predetermined number of updates or when the number c' of bits of the integer signal code output from the first periodicity-based variable-length encoder 2103 is equal to the number B of allocated bits, the determiner 1104' outputs the quantized normalized coefficient sequence $X_Q(1), \ldots, X_Q(N)$ and the integer signal code that are input from the first periodicity-based variable-length encoder 2103. The integer signal code output from the determiner 1104' is a "first periodicity-based integer signal code".

The quantized normalized coefficient sequence $X_Q(1), \ldots, X_Q(N)$ output from the determiner 1104' is input into the second non-periodicity-based variable-length encoder 2120 and the comparison selector 2300. In addition, the first periodicity-based integer signal code, which is the integer signal code output from the determiner 1104', is input into the comparison selector 2300.

When the number of updates of the gain is smaller than a predetermined number of updates and the number c' of bits of the integer signal code output from the first periodicity-based variable-length encoder 2103 is greater than the number B of allocated bits, the determiner 1104' performs control to cause a minimum gain setter 1105 to perform the process described previously; when the number of updates of the gain is smaller than the predetermined number of updates and the number c' of bits is smaller than the number B of allocated bits, the determiner 1104' performs control to cause a maximum gain setter 1109 to perform the process described previously. The subsequent processes performed by the minimum gain setter 1105, a first branching unit 1106, a first gain updater 1107, a gain increaser 1108, the maximum gain setter 1109, a second branching unit 1110, a second gain updater 1111, and a gain reducer 1112 are as described in the section on the periodicity-based gain adjustment code amount estimator 1100 (FIG. 2).

<Second Non-Periodicity-Based Variable-Length Encoder 2120 (FIG. 5)>

A process by the second non-periodicity-based variable-length encoder 2120 is performed when it is determined by a periodicity analyzer 1004 or the like that the indicator S of the degree of periodicity is greater than the predetermined threshold TH (periodicity is high). The second non-periodicity-based variable-length encoder 2120 encodes the quantized normalized coefficient sequence $X_Q(1), \ldots, X_Q(N)$ (i.e. an integer value sequence obtained by the periodicity-based gain adjustment encoder 2100) output from the periodicity-based gain adjustment encoder 2100 by using a non-periodicity-based variable-length encoding method to obtain an integer signal code corresponding to the quantized normalized coefficient sequence $X_Q(1), \ldots, X_Q(N)$ and the amount of code (the number of bits) of the integer signal code and outputs the integer signal code. An example of the non-periodicity-based variable-length encoding is as described in the section on the second non-periodicity-based variable-length code amount estimator 1120. The code is referred to as the "second non-periodicity-based integer signal code" since the integer signal code output from the second non-periodicity-based variable-length encoder 2120 is a code obtained by encoding using a non-periodicity-based encoding method. The second non-periodicity-based integer signal code, which is the integer signal code output from the second non-periodicity-based variable-length encoder 2120, is input into the comparison selector 2300.

<Non-Periodicity-Based Gain Adjustment Encoder 2200 (FIG. 5)>

A process by the non-periodicity-based gain adjustment encoder 2200 is performed when it is determined by the periodicity analyzer 1004 or the like that the indicator S is lower than or equal to the predetermined threshold TH (periodicity is low). The non-periodicity-based gain adjustment encoder 2200 takes the input of the weighted normalized MDCT coefficient string $X_N(1), \ldots, X_N(N)$ and adjusts the gain g by a gain loop process to obtain and output a quantized normalized coefficient sequence $X_Q(1), \ldots, X_Q(N)$ such that the amount of code (the number of bits) of an integer signal code that is obtained by encoding the quantized normalized coefficient sequence $X_Q(1), \ldots, X_Q(N)$ using the non-periodicity-based encoding method is less than or equal to the number B of allocated bits, which is the number of bits allocated in advance, and is as large as possible. The non-periodicity-based gain adjustment encoder 2200 outputs the integer signal code. The code is referred to as the "first non-periodicity-based integer signal code" since the integer signal code output from the non-periodicity-based gain adjustment encoder 2200 is a code obtained using a non-periodicity-based encoding method. That is, the non-periodicity-based gain adjustment encoder 2200 differs from the periodicity-based gain adjustment encoder 2100 in that whereas the periodicity-based gain adjustment encoder 2100 obtains an "integer signal code that is obtained by encoding using a periodicity-based encoding method", the non-periodicity-based gain adjustment encoder 2200 obtains an "integer signal code that is obtained by encoding using a non-periodicity-based encoding method".

Figure 7:
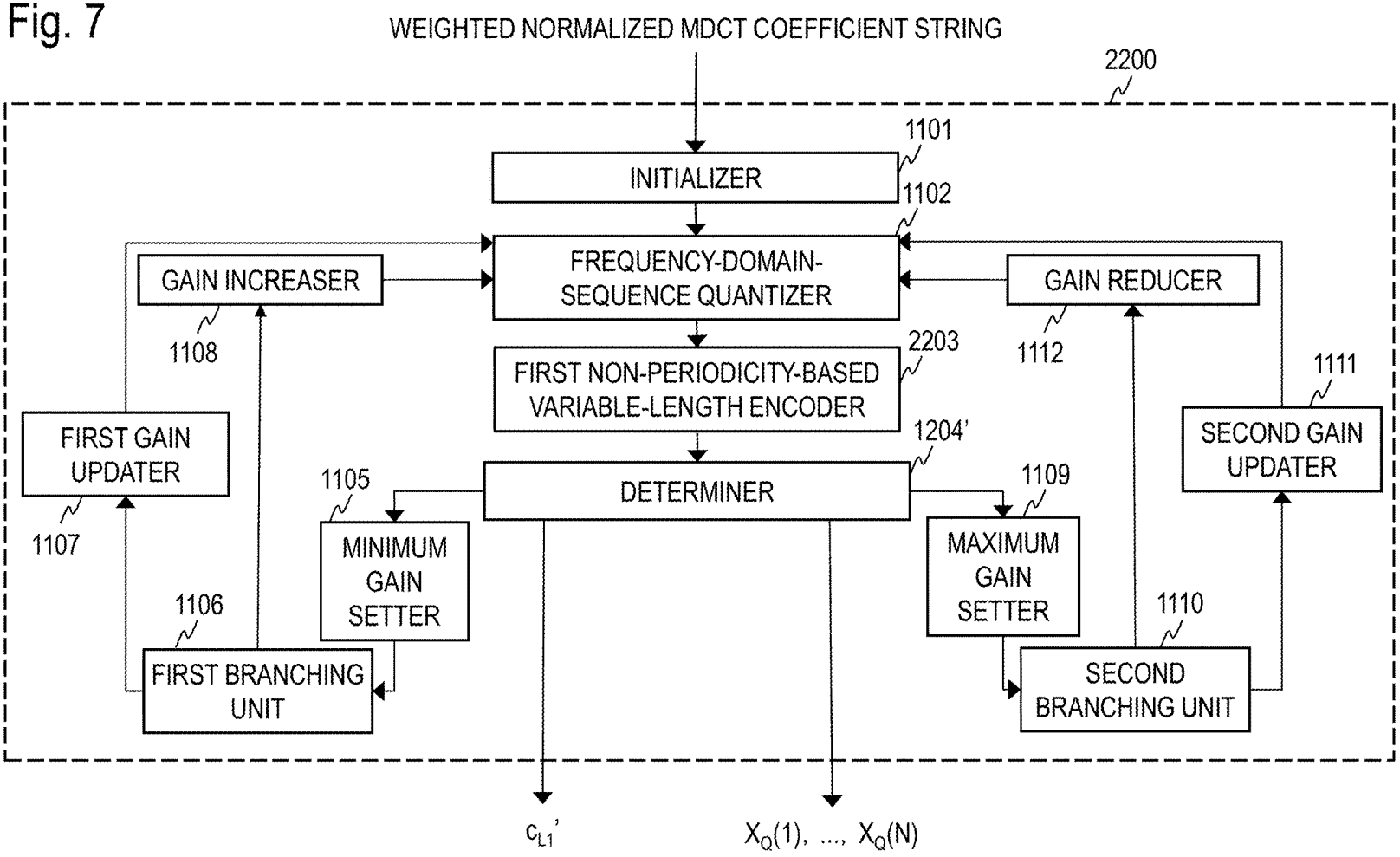
FIG. 7 is a block diagram illustrating an exemplary configuration of a non-periodicity-based gain adjustment encoder according to the second embodiment.

FIG. 7 illustrates a detailed exemplary configuration of the non-periodicity-based gain adjustment encoder 2200. The non-periodicity-based gain adjustment encoder 2200 is identical with the periodicity-based gain adjustment code amount estimator 1100 except that the first periodicity-based variable-length code amount estimator 1103 is replaced with a first non-periodicity-based variable-length encoder 2203 and the determiner 1104 is replaced with a determiner 1204'. Accordingly, the other parts have the same functions of those of the periodicity-based gain adjustment code amount estimator 1100 except that the code amount (non-periodicity-based code amount) of an integer signal code output from the first non-periodicity-based variable-length encoder 2203 is used instead of a code amount estimated value (periodicity-based code amount estimated value) output from the first periodicity-based variable-length code amount estimator 1103. Therefore, the processing parts that perform in principle the same processes as those of the periodicity-based gain adjustment code amount estimator 1100 are given the same names and reference numerals. The processing parts that are given the same names and reference numerals in FIGS. 6 and 7 may be physically the same processing parts or physically different processing parts. The following description will focus on processes that are different from those of the periodicity-based gain adjustment code amount estimator 1100.

<First Non-Periodicity-Based Variable-Length Encoder 2203 (FIG. 7)>

The first non-periodicity-based variable-length encoder 2203 encodes the quantized normalized coefficient sequence $X_Q(1), \ldots, X_Q(N)$ output from the frequency-domain-sequence quantizer 1102 by using the non-periodicity-based variable-length encoding method to obtain an integer signal code corresponding to the quantized normalized coefficient sequence $X_Q(1), \ldots, X_Q(N)$ and outputs the integer signal code and the quantized normalized coefficient sequence $X_Q(1), \ldots, X_Q(N)$. The integer signal code and the quantized normalized coefficient sequence $X_Q(1), \ldots, X_Q(N)$ output from the first non-periodicity-based variable-length encoder 2203 are input into the determiner 1204'. An example of the non-periodicity-based variable-length encoding method is as described in the section on the second non-periodicity-based variable-length code amount estimator 1120.

The first non-periodicity-based variable-length encoder 2203 differs from the second non-periodicity-based variable-length encoder 2120 in that the first non-periodicity-based variable-length encoder 2203 encodes the quantized normalized coefficient sequence $X_Q(1), \ldots, X_Q(N)$ output from the frequency-domain-sequence quantizer 1102 whereas the second non-periodicity-based variable-length encoder 2120 encodes the quantized normalized coefficient sequence $X_Q(1), \ldots, X_Q(N)$ output from the periodicity-based gain adjustment encoder 2100 and that the first non-periodicity-based variable length encoder 2203 outputs the quantized normalized coefficient sequence $X_Q(1), \ldots, X_Q(N)$ in addition to an integer signal code and the number c' of bits.

<Determiner 1204'>

When the number of updates of gain is equal to a predetermined number of updates or the number c' of bits (non-periodicity-based code amount) of an integer signal code output from the first non-periodicity-based variable-length encoder 2203 is equal to the number B of allocated bits, the determiner 1204' outputs a quantized normalized coefficient sequence $X_Q(1), \ldots, X_Q(N)$ and the integer signal code. The integer signal code output from the determiner 1204' is a "first non-periodicity-based integer signal code".

The quantized normalized coefficient sequence $X_Q(1), \ldots, X_Q(N)$ output from the determiner 1204' is input into the second periodicity-based variable-length encoder 2220 and the comparison selector 2300. The first non-periodicity-based integer signal code, which is the integer signal code output from the determiner 1204', is input into the comparison selector 2300.

When the number of updates of the gain is smaller than the predetermined number of updates and the number c' of bits of the integer signal code output from the first non-periodicity-based variable-length encoder 2203 is greater than the number B of allocated bits, the determiner 1204' performs control to cause the minimum gain setter 1105 to perform the process described previously; when the number of updates of gain is smaller than the predetermined number of updates and the number c' of bits is smaller than the number B of allocated bits, the determiner 1204' performs control to cause the maximum gain setter 1109 to perform the process described previously. The subsequent processes performed by the minimum gain setter 1105, the first branching unit 1106, the first gain updater 1107, the gain increaser 1108, the maximum gain setter 1109, the second branching unit 1110, the second gain updater 1111, and the gain reducer 1112 are as described in the section on the periodicity-based gain adjustment code amount estimator 1100 (FIG. 2).

<Second Periodicity-Based Variable-Length Encoder 2220 (FIG. 5)>

A process by the second periodicity-based variable-length encoder 2220 is performed when it is determined by the periodicity analyzer 1004 or the like that the indicator S is lower than or equal to the predetermined threshold TH (periodicity is low). The second periodicity-based variable-length encoder 2220 takes the inputs of the quantized normalized coefficient sequence $X_Q(1), \ldots, X_Q(N)$ output from the non-periodicity-based gain adjustment encoder 2200 and the period T output from the periodicity analyzer 1004, encodes the quantized normalized coefficient sequence $X_Q(1), \ldots, X_Q(N)$ using a periodicity-based encoding method as variable-length encoding to obtain an integer signal code corresponding to the quantized normalized coefficient sequence $X_Q(1), \ldots, X_Q(N)$, and outputs the integer signal code. The integer signal code is referred to as the "second periodicity-based integer signal code" since the integer signal code output from the second periodicity-based variable-length encoder 2220 is a code obtained using a periodicity-based encoding method. The second periodicity-based integer signal code, which is the integer signal code output from the second periodicity-based variable-length encoder 2220, is input into the comparison selector 2300. An example of the periodicity-based encoding method is as described in the section on the first periodicity-based variable-length code amount estimator 1103.

The second periodicity-based variable-length encoder 2220 differs from the first periodicity-based variable-length encoder 2103 in that whereas the first periodicity-based variable-length encoder 2103 encodes the quantized normalized coefficient sequence $X_Q(1), \ldots, X_Q(N)$ output from the frequency-domain-sequence quantizer 1102, the second periodicity-based variable-length encoder 2220 encodes the quantized normalized coefficient sequence $X_Q(1), \ldots, X_Q(N)$ output from the non-periodicity-based gain adjustment encoder 2200 and that the first periodicity-based variable-length encoder 2103 outputs the quantized normalized coefficient sequence $X_Q(1), \ldots, X_Q(N)$ in addition to a first periodicity-based code amount $c_{H1}'$ and a first periodicity-based integer signal code.

<Comparison Selector 2300>

An integer signal code obtained using an encoding method assumed in the gain loop process (i.e. an encoding method that is expected to produce a smaller amount of code), that is, an integer signal code output from the periodicity-based gain adjustment encoder 2100 or the non-periodicity-based gain adjustment encoder 2200 will be referred to as the first code. An integer signal code obtained by substituting the quantized normalized coefficient sequence $X_Q(1), \ldots, X_Q(N)$ obtained with the assumption that an encoding method that is expected to produce a smaller amount of code is used, i.e. an integer signal code output from the second non-periodicity-based variable-length encoder 2120 or the second periodicity-based variable-length encoder 2220 will be referred to as the second code. In other words, when the indicator S of the degree of periodicity is greater than the predetermined threshold TH (periodicity is high), the first code is the first periodicity-based integer signal code and the second code is the second non-periodicity-based integer signal code. When the indicator S of the degree of periodicity is lower than or equal to the predetermined threshold TH (periodicity is low), the first code is a first non-periodicity-based integer signal code and the second code is a second periodicity-based integer signal code.

The first code, the second code, the quantized normalized coefficient sequence $X_Q(1), \ldots, X_Q(N)$, the period T and the indicator S of the degree of periodicity are input into the comparison selector 2300.

The comparison selector 2300 compares the input first code with the input second code and outputs the integer signal code that is smaller in the amount of code and the quantized normalized coefficient sequence $X_Q(1), \ldots, X_Q(N)$.

Specifically, when the indicator S of the degree of periodicity is greater than the predetermined threshold TH (periodicity is high), the comparison selector 2300 compares the first periodicity-based integer signal code output from the periodicity-based gain adjustment encoder 2100 with the second non-periodicity-based integer signal code output from the second non-periodicity-based variable-length encoder 2120 and selects as the integer signal code the code that is smaller in the amount of code out of the first periodicity-based integer signal code and the second non-periodicity-based integer signal code.

When the indicator S of the degree of periodicity is less than the predetermined threshold TH (periodicity is low), the comparison selector 2300 compares the first non-periodicity-based integer signal code output from the non-periodicity-based gain adjustment encoder 2200 with the second periodicity-based integer signal code output from the second periodicity-based variable-length encoder 2220 and selects as the integer signal code the code that is smaller in the amount of code out of the first non-periodicity-based integer signal code and the second periodicity-based integer signal code.

Specifically, when the first periodicity-based code amount (the code amount of the first periodicity-based integer signal code) $c_{H1}'$ is greater than the second non-periodicity-based code amount (the code amount of the second non-periodicity-based integer signal code) $c_{L2}'$, the comparison selector 2300 selects as the integer signal code the second non-periodicity-based integer signal code and outputs the quantized normalized coefficient sequence $X_Q(1), \ldots, X_Q(N)$ output from the periodicity-based gain adjustment encoder 2100. When the first periodicity-based code amount (the code amount of the first periodicity-based integer signal code) $c_{H1}'$ is smaller than the second non-periodicity-based code amount (the code amount of the second non-periodicity-based integer signal code) $c_{L2}'$, the comparison selector 2300 selects as the integer signal code the first periodicity-based integer signal code and outputs the quantized normalized coefficient sequence $X_Q(1), \ldots, X_Q(N)$ output from the periodicity-based gain adjustment encoder 2100. When the first non-periodicity-based code amount $c_{L1}'$ (the code amount of the first non-periodicity-based integer signal code) is greater than the second periodicity-based code amount (the code amount of the second periodicity-based integer signal code) $c_{H2}'$, the comparison selector 2300 selects as the integer signal code the second periodicity-based integer signal code and outputs the quantized normalized coefficient sequence $X_Q(1), \ldots, X_Q(N)$ output from the non-periodicity-based gain adjustment encoder 2200. When the first non-periodicity-based code amount (the code amount of the first non-periodicity-based integer signal code) $c_{L1}'$ is smaller than the second periodicity-based code amount (the code amount of the second periodicity-based integer signal code) $c_{H2}'$, the comparison selector 2300 selects as the integer signal code the first non-periodicity-based integer signal code and outputs the quantized normalized coefficient sequence $X_Q(1), \ldots, X_Q(N)$ output from the non-periodicity-based gain adjustment encoder 2200.

Note that while in principle any of the two codes may be selected when $c_1'=c_2'$, it is assumed here that the first code, for example, is preferentially selected.

Further, when the number of bits of the integer signal code that is smaller in the code amount out of the first and second codes is greater than the number B of allocated bits, the comparison selector 2300 removes the amount of the code by which the number of bits exceeds the number B of allocated bits (a truncation code) from the integer signal code and outputs the resulting signal code as the integer signal code. When the number of bits of the integer signal code that is smaller in the code amount out of the input first and second codes is not greater than the number B of allocated bits, the comparison selector 2300 outputs the integer signal code without truncation. The integer signal code output from the comparison selector 2300 is transmitted to the decoder.

Note that while a configuration has been described above in which the periodicity-based gain adjustment encoder 2100 obtains a first periodicity-based integer signal code and the comparison selector 2300 calculates and uses the code amount $c_{H1}'$ of the input first periodicity-based integer signal code, the periodicity-based gain adjustment encoder 2100 may obtain the first periodicity-based code amount $c_{H1}'$, which is the code amount of the first periodicity-based integer signal code, and then the comparison selector 2300 may use the input first periodicity-based code amount $c_{H1}'$. The same applies to the second non-periodicity-based code amount $c_{L2}'$, the first non-periodicity-based code amount $c_{L1}'$, and the second periodicity-based code amount $c_{H2}'$: each of the encoders may obtain a code amount and then the comparison selector 2300 may use the input code amount.

[Third Modification]

As in the first modification described previously, when a predetermined number of updates of the gain which specifies the upper-limit number of updates of the gain in the gain loop process described above is large enough, code truncation does not occur at the periodicity-based gain adjustment encoder 2100 and the non-periodicity-based gain adjustment encoder 2200. On the other hand, code truncation can occur at the second non-periodicity-based variable-length encoder 2120 and the second periodicity-based variable-length encoder 2220, which obtain an integer signal code by substituting the quantized normalized coefficient sequence $X_Q(1), \ldots, X_Q(N)$ obtained by performing the gain loop process. Since quantized normalized coefficients corresponding to the removed portion of the code cannot be decoded at the decoder, the quality of a decoded audio signal decreases accordingly. Therefore, it is preferable that code truncation do not occur. In view of this, the comparison selector 2300 may compare the first code with the second code only when code truncation does not occur at the second non-periodicity-based variable-length encoder 2120 and the second periodicity-based variable-length encoder 2220. In this case, the comparison selector 2300 performs the following process.

When the number of bits of the second code is smaller than or equal to the number B of allocated bits and the second code is smaller than the first code, the second code is output as the integer signal code; otherwise, the first code is output as the integer signal code. Specifically, a process for the case of high periodicity and a process for the case of low periodicity are performed as described below.

[when it is Determined that the Indicator S of the Degree of Periodicity is Greater than the Predetermined Threshold Value TH (Periodicity is High)]

When the number of bits of the second non-periodicity-based integer signal code output from the second non-periodicity-based variable-length encoder 2120 is smaller than or equal to the number B of allocated bits (i.e. code truncation has not occurred) and the code amount of the second non-periodicity-based integer signal code is smaller than the code amount of a first periodicity-based integer signal code, the comparison selector 2300 outputs the second non-periodicity-based integer signal code. Otherwise, the comparison selector 2300 outputs the first periodicity-based integer signal code.

[When it is Determined that the Indicator S of the Degree of Periodicity is Less than the Predetermined Threshold TH (Periodicity is Low)]

When the number of bits of a second periodicity-based integer signal code output from the second periodicity-based variable-length encoder 2220 is smaller than or equal to the number B of allocated bits (i.e. code truncation has not occurred) and the code amount of the second periodicity-based integer signal code is smaller than the code amount of a first non-periodicity-based integer signal code, the comparison selector 2300 outputs the second periodicity-based integer signal code. Otherwise, the comparison selector 2300 outputs the first non-periodicity-based integer signal code.

[Fourth Modification]

As in the third modification described above, the comparison selector 2300 may compare a code amount obtained using a periodicity-based encoding method plus the code amount c(T) of a code corresponding to the period T with a code amount obtained using a non-periodicity-based encoding method.

Specifically, when an indicator S of the degree of periodicity is higher than a predetermined threshold TH (periodicity is high), $c_1'+c(T)$ may be compared with $c_2'$, where $c_1'$ is the code amount of a first code and $c_2'$ is the code amount of a second code; when the indicator S of the degree of periodicity is lower than or equal to the predetermined threshold TH (periodicity is low), $c_1'$ may be compared with $c_2'+c(T)$. In other words, the process "when the code amount $c_{H1}'=c_1'$ of the first periodicity-based integer signal code is greater than the code amount $c_{L2}'=c_2'$ of the second non-periodicity-based integer signal code" described above may be performed "when the code amount $c_1'$ of the first periodicity-based integer signal code plus the code amount c(T), $c_1'+c(T)$, is greater than the code amount $c_2'$ of the second non-periodicity-based integer signal code"; the process "when the code amount $c_{H1}'=c_1'$ of the first periodicity-based integer signal code is smaller than the code amount $c_{L2}'=c_2'$ of the second non-periodicity-based integer signal code" described above may be performed "when the code amount $c_1'$ of the first periodicity-based integer signal code plus the code amount c(T), $c_1'+c(T)$, is smaller than the code amount $c_2'$ of the second non-periodicity-based integer signal code"; and the process "when $c_1'=c_2'''$ described above may be performed "when $c_1'+c(T)=c_2'''$". Similarly, the process "when the code amount $c_{L1}'=c_1'$ of the first non-periodicity-based integer signal code is greater than the code amount $c_{H2}'=c_2'$ of the second periodicity-based integer signal code" described above may be performed "when the code amount $c_1'$ of the first non-periodicity-based integer signal code is greater than the code amount $c_2'$ of the second periodicity-based integer signal code plus the code amount c(T)', $c_2'+c(T)'''$; the process "when the code amount $c_{L1}'=c_1'$ of the first non-periodicity-based integer signal code is smaller than the code amount $c_{H2}'=c_2'$ of the second periodicity-based integer signal code" described above may be performed "when the code amount $c_1'$ of the first non-periodicity-based integer signal code is smaller than the code amount $c_2'$ of the second periodicity-based integer signal code plus the code amount c(T)', $c_2'+c(T)'''$; and the process "when $c_1'=c_2'''$ described above may be performed "when $c_1'=c_2'+c(T)$". Alternatively, a comparison between code amounts that takes into account the code amount c(T)

of a code corresponding to the period T as described may be made in the mode described in the third modification.

[Other Modifications]

The present invention is not limited to the embodiments described above. For example, the gain loop process is not limited to the process described above. The gain loop process may be any process in which each of the coefficients in an input weighted normalized MDCT coefficient string $X_N(1), \ldots, X_N(N)$ is divided by a gain g and the resulting string $X_N(1)/g, \ldots, X_N(N)/g$ is quantized to obtain a quantized normalized coefficient sequence $X_Q(1), \ldots, X_Q(N)$ which is a sequence of integer values, and the gain g is found such that an "estimated number of bits of code" or the "number of bits of code" that correspond to the quantized normalized coefficient sequence $X_Q(1), \ldots, X_Q(N)$ is smaller than or equal to the number B of allocated bits, which is the number of bits allocated in advance, and is as large as possible. Note that the "estimated number of bits of code" when the indicator S of the degree of periodicity is greater than a predetermined threshold TH (periodicity is high) is an estimated value of the code amount of the quantized normalized coefficient sequence $X_Q(1), \ldots, X_Q(N)$ that is estimated with the assumption that the periodicity based encoding method is used to encode the quantized normalized coefficient sequence $X_Q(1), \ldots, X_Q(N)$ and the "number of bits of code" is the code amount of a code that is obtained by encoding the quantized normalized coefficient sequence $X_Q(1), \ldots, X_Q(N)$ using the periodicity based encoding method. The "estimated number of bits of code" when the indicator S of the degree of periodicity is less than or equal to the predetermined threshold TH (periodicity is low) is an estimated value of the code amount of the quantized normalized coefficient sequence $X_Q(1), \ldots, X_Q(N)$ that is estimated with the assumption that the quantized normalized coefficient sequence $X_Q(1), \ldots, X_Q(N)$ is encoded using the non-periodicity based encoding method and the "number of bits of code" is the code amount of code obtained by encoding the quantized normalized coefficient sequence $X_Q(1), \ldots, X_Q(N)$ using the non-periodicity based encoding method. Any such gain loop process may be used. For example, the gain g may be updated by an amount of update proportional to the difference between the number of bits (or an estimated number of bits) of a quantized normalized coefficient sequence $X_Q(1), \ldots, X_Q(N)$ corresponding to the gain g and the number B of allocated bits. For example, when the number of bits or an estimated number of bits of the quantized normalized coefficient sequence $X_Q(1), \ldots, X_Q(N)$ corresponding to the gain g (hereinafter referred to as the number of consumed bits) is greater than the number B of allocated bits and no upper bound of the gain is set, the value of the gain g may be updated so that the greater the number of some or all of the samples in the quantized normalized coefficient sequence $X_Q(1), \ldots, X_Q(N)$ minus the number of samples remaining after removing quantized normalized coefficients that correspond to the amount of removed portion of a code that corresponds to the number of bits by which the number of consumed bits exceeds the number of allocated bits from the quantized normalized coefficient sequence $X_Q(1), \ldots, X_Q(N)$, the greater the increment by which the gain g is updated. When the number of consumed bits is smaller than the number B of allocated bits and no lower bound of the gain g is set, the value of the gain may be updated so that the greater the number B of allocated bits minus the number of consumed bits, the greater the decrement by which the gain is updated. The term "gain loop process" means a process in which predetermined processing is performed one or more times until a predetermined condition is satisfied. In the gain loop process, predetermined processing may or may not be repeated.

In the embodiments described above, instead of rounding off a value to the nearest integer, a fractional part of the value can be dropped or rounded up to the nearest integer. Determination as to whether a is greater than 13 may be made by comparing $\alpha$ with $\beta$ to determine whether $\alpha>\beta$ or may be made by comparing $\alpha$ with $\gamma$ (where $\gamma>\beta$) to determine whether $\alpha\geq\gamma$. That is, it may be determined whether or not the indicator S corresponds to high periodicity on the basis of whether or not the indicator S is greater than a predetermined threshold TH or whether or not the indicator S is greater than or equal to a predetermined threshold TH' (where TH'>TH). In other words, "the indicator S is greater than the predetermined threshold TH" in the embodiments and their modifications may be replaced with "the indicator S is greater than or equal to the predetermined threshold TH'" and "the indicator S is greater than or equal to the predetermined threshold TH" may be replaced with "the indicator S is greater than the predetermined threshold TH'".

The processes described above may be performed not only in time sequence as is written but also in parallel or individually, depending on the throughput of the devices that perform the processes or requirements. It would be understood that modifications can be made as appropriate without departing from the spirit of the present invention.

If the configurations described above are implemented by a computer, processing of the function that each device needs to include is described in a program. The program is executed on the computer to implement the processing functions described above on the computer. The program describing the processes can be recorded on a computer-readable recording medium. An example of the computer-readable recording medium is a non-transitory recording medium. Examples of such recording medium include recording media such as a magnetic recording device, an optical disc, a magneto-optical recording medium, and a semiconductor memory.

The program may be distributed, for example, by selling, transferring, or lending a portable recording medium on which the program is recorded, such as a DVD or a CD-ROM. The program may be stored on a storage device of a server computer and transferred from the server computer to other computers over a network, thereby distributing the program.

A computer that executes the program first stores the program recorded on a portable recording medium or the program transferred from a server computer into a storage device of the computer. When the computer executes the processes, the computer reads the program stored in the recording device of the computer and executes the processes according to the read program. In another mode of execution of the program, the computer may read the program directly from a portable recording medium and may execute the processes according to the program or may execute the processes according to the program each time the program is transferred from a server computer to the computer. Alternatively, the processes may be executed using a so-called ASP (Application Service Provider) service in which the program is not transferred from a server computer to the computer but processing functions are implemented only by instructions to execute the program and acquisition of the results of the execution.

While a predetermined program is executed on a computer to implement the processing functions of the device in the embodiments described above, at least some of the processing functions may be implemented by hardware.

DESCRIPTION OF REFERENCE NUMERALS

100, 200 Encoder
1100 Periodicity-based gain adjustment code amount estimator
1120 Second non-periodicity-based variable-length code amount estimator
1200 Non-periodicity-based gain adjustment code amount estimator
1220 Second periodicity-based variable-length code amount estimator
2100 Periodicity-based gain adjustment encoder
2120 Second non-periodicity-based variable-length encoder
2200 Non-periodicity-based gain adjustment encoder
2220 Second periodicity-based variable-length encoder

What is claimed is:

1. An encoding method comprising:

a frequency-domain sample string generating step of obtaining a frequency-domain sample string derived from an audio signal in each predetermined time interval;

a periodicity analyzing step of calculating an indicator of the degree of periodicity of the frequency-domain sample string;

a periodicity-based gain adjustment code amount estimating step of, when the indicator corresponds to high periodicity, obtaining a first integer value sequence and a first periodicity-based code amount estimated value by adjusting a value of a first gain by a loop process, the first integer value sequence being a sequence of integer value samples which are obtained by dividing each sample in the frequency-domain sample string by the first gain, the first periodicity-based code amount estimated value being an estimated value of the code amount of a code corresponding to the first integer value sequence which is estimated with the assumption that the first integer value sequence is encoded using a periodicity-based encoding method;

a second non-periodicity-based code amount estimating step of, when the indicator corresponds to high periodicity, obtaining a second non-periodicity-based code amount estimated value which is an estimated value of the code amount of a code corresponding to the first integer value sequence which is estimated with the assumption that the first integer value sequence is encoded using a non-periodicity-based encoding method;

a non-periodicity-based gain adjustment code amount estimating step of, when the indicator does not correspond to high periodicity, obtaining a second integer value sequence and a first non-periodicity-based code amount estimated value by adjusting a value of a second gain by a loop process, the second integer value sequence being a sequence of integer value samples which are obtained by dividing each sample in the frequency-domain sample string by the second gain, the first non-periodicity-based code amount estimated value being an estimated value of the code amount of a code corresponding to the second integer value sequence which is estimated with the assumption that the second integer value sequence is encoded using the non-periodicity-based encoding method;

a second periodicity-based code amount estimating step of, when the indicator does not correspond to high periodicity, obtaining a second periodicity-based code amount estimated value which is an estimated value of the code amount of a code corresponding to the second integer value sequence which is estimated with the assumption that the second integer value sequence is encoded using the periodicity-based encoding method; and a comparison and selection encoding step of, when the first periodicity-based code amount estimated value plus the code amount of a code corresponding to a period for encoding by using the periodicity-based encoding method is greater than the second non-periodicity-based code amount estimated value, encoding the first integer value sequence using the non-periodicity-based encoding method to obtain and output a code corresponding to the first integer value sequence, when the first periodicity-based code amount estimated value plus the code amount of the code corresponding to the period is smaller than the second non-periodicity-based code amount estimated value, encoding the first integer value sequence by using the periodicity-based encoding method to obtain and output a code corresponding to the first integer value sequence, when the first non-periodicity-based code amount estimated value is greater than the second periodicity-based code amount estimated value plus the code amount of the code corresponding to the period, encoding the second integer value sequence by using the periodicity-based encoding method to obtain and output a code corresponding to the second integer value sequence, and when the first non-periodicity-based code amount estimated value is smaller than the second periodicity-based code amount estimated value plus the code amount of the code corresponding to the period, encoding the second integer value sequence by using the non-periodicity-based encoding method to obtain and output a code corresponding to the second integer value sequence.

2. A non-transitory computer-readable recording medium storing a program for causing a computer to execute the steps of the encoding method according to claim 1.

3. An encoding apparatus comprising:

a frequency-domain sample string generator which obtains a frequency-domain sample string derived from an audio signal in each predetermined time interval;

a periodicity analyzer which calculates an indicator of the degree of periodicity of the frequency-domain sample string;

a periodicity-based gain adjustment code amount estimator which, when the indicator corresponds to high periodicity, obtains a first integer value sequence and a first periodicity-based code amount estimated value by adjusting a value of a first gain by a loop process, the first integer value sequence being a sequence of integer value samples which are obtained by dividing each sample in the frequency-domain sample string by the first gain, the first periodicity-based code amount estimated value being an estimated value of the code amount of a code corresponding to the first integer value sequence which is estimated with the assumption that the first integer value sequence is encoded using a periodicity-based encoding method;

a second non-periodicity-based code amount estimator which, when the indicator corresponds to high periodicity, obtains a second non-periodicity-based code amount estimated value which is an estimated value of the code amount of a code corresponding to the first integer value sequence which is estimated with the assumption that the first integer value sequence is encoded using a non-periodicity-based encoding method;

a non-periodicity-based gain adjustment code amount estimator which, when the indicator does not correspond to high periodicity, obtains a second integer value sequence and a first non-periodicity-based code amount estimated value by adjusting a value of a second gain by a loop process, the second integer value sequence being a sequence of integer value samples which are obtained by dividing each sample in the frequency-domain sample string by the second gain, the first non-periodicity-based code amount estimated value being an estimated value of the code amount of a code corresponding to the second integer value sequence which is estimated with the assumption that the second integer value sequence is encoded using the non-periodicity-based encoding method;

a second periodicity-based code amount estimator which, when the indicator does not correspond to high periodicity, obtaining a second periodicity-based code amount estimated value which is an estimated value of the code amount of a code corresponding to the second integer value sequence which is estimated with the assumption that the second integer value sequence is encoded using the periodicity-based encoding method; and a comparison and selection encoder which, when the first periodicity-based code amount estimated value plus the code amount of a code corresponding to a period for encoding by using the periodicity-based encoding method is greater than the second non-periodicity-based code amount estimated value, encodes the first integer value sequence using the non-periodicity-based encoding method to obtain and output a code corresponding to the first integer value sequence, when the first periodicity-based code amount estimated value plus the code amount of the code corresponding to the period is smaller than the second non-periodicity-based code amount estimated value, encodes the first integer value sequence by using the periodicity-based encoding method to obtain and output a code corresponding to the first integer value sequence;

when the first non-periodicity-based code amount estimated value is greater than the second periodicity-based code amount estimated value plus the code amount of the code corresponding to the period, encodes the second integer value sequence by using the periodicity-based encoding method to obtain and output a code corresponding to the second integer value sequence, and when the first non-periodicity-based code amount estimated value is smaller than the second periodicity-based code amount estimated value plus the code amount of the code corresponding to the period, encodes the second integer value sequence by using the non-periodicity-based encoding method to obtain and output a code corresponding to the second integer value sequence.

* * * * *